US007815297B2

(12) United States Patent
Kotaki et al.

(10) Patent No.: US 7,815,297 B2
(45) Date of Patent: Oct. 19, 2010

(54) INK JET RECORDING HEAD AND INK JET RECORDING APPARATUS HAVING A PLURALITY OF INK FLOW PATHS

(75) Inventors: Yasuo Kotaki, Yokohama (JP); Ryoji Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 757 days.

(21) Appl. No.: 11/753,165

(22) Filed: May 24, 2007

(65) Prior Publication Data

US 2007/0273733 A1 Nov. 29, 2007

(30) Foreign Application Priority Data

May 29, 2006 (JP) ..... 2006-148841

(51) Int. Cl.
*B41J 2/175* (2006.01)

(52) U.S. Cl. ..... 347/86; 347/65

(58) Field of Classification Search ..... 347/20, 347/56, 61–65, 67, 84–87, 92–94
See application file for complete search history.

(56) References Cited

U.S. PATENT DOCUMENTS 6,220,697 B1 4/2001 Yamanaka et al.
6,241,350 B1 6/2001 Otsuka et al.
6,293,652 B1 9/2001 Arashima et al.
7,097,287 B2 * 8/2006 Nakao et al. ..... 347/85
2002/0113845 A1 8/2002 Yazawa et al.

FOREIGN PATENT DOCUMENTS

CN 1375398 10/2002
EP 1 228 876 A2 8/2002
JP 2004-216761 8/2004

OTHER PUBLICATIONS

Official Letter dated Mar. 25, 2009 in corresponding Korean Patent Application No. 10-2007-52006.
Official Letter/Search Report issued by the European Patent Office on Sep. 20, 2007, in European Patent Application No. 07108965.0.

* cited by examiner

*Primary Examiner*—Juanita D Stephens
(74) *Attorney, Agent, or Firm*—Fitzpatrick, Cella, Harper & Scinto

(57) ABSTRACT

An ink jet recording head for ejecting, through an ink ejection outlet, ink introduced through an ink supply port includes a first ink flow path in fluid communication with the ink supply port; a second ink flow path which is branched from the first ink flow path at a branch portion and which is in fluid communication with the ink ejection outlet; and a third ink flow path for fluid communication between the branch portion and an outside.

21 Claims, 20 Drawing Sheets

PRIOR ART

INK JET RECORDING HEAD AND INK JET RECORDING APPARATUS HAVING A PLURALITY OF INK FLOW PATHS

FIELD OF THE INVENTION AND RELATED ART

The present invention relates to an ink jet recording head capable of jetting ink, and an ink jet recording apparatus employing an ink jet recording head. Not only is the present invention applicable to an ordinary ink jet printer, but also, a copying machine, a facsimile machine having a communicating system, a wordprocessor having a printing portion, a multifunction recording apparatus capable of performing two or more of the functions of the preceding machines.

An ink container remains stationary during distribution, during a period in which a recording apparatus in which an ink container is held is not used, or the like situations. If an ink container which contains pigment ink is left stationary for a long period of time, the ink in the container sometimes becomes nonuniform in pigment concentration, in terms of the vertical direction, because the pigment in the ink has a tendency to agglomerate and sediment. Thus, if the pigment ink in an ink container is supplied from the ink container to an ink jet recording head while remaining in the abovementioned condition, ink droplets jetted from the recording head are nonuniform in pigment concentration, making it possible that the image forming apparatus will yield inferior images.

One of the conventional solutions (solution in accordance with prior art) to the abovementioned problem is as follows: Before a user mounts an ink container into a recording apparatus, the user is to manually shake the ink container in order to make the ink in the ink container uniform in pigment concentration by breaking up the agglomeration of pigment.

Japanese Laid-open Patent Application 2004-216761 discloses a solution to the abovementioned problem, which is different from the preceding solution. In this case, a recording apparatus is of the serial scan type, and an ink container is mounted on the carriage of the recording apparatus. Thus, the pigment ink in the ink container is stirred by utilizing the inertia which occurs as the carriage is moved in the manner of scanning recording medium.

Further, if a recording apparatus in which an ink container is mounted is left unused for a long time after its usage, it is possible that the phenomenon that pigment in ink sediments will occur even in the ink passage which connects the ink container and ink jet recording head. As one of the solutions to this problem, some conventional ink jet recording apparatuses are designed to periodically carry out a recovery operation, that is, an operation for discharging the ink in the ink passage.

FIG. 23 shows one of the conventional ink jet recording cartridges 100, which is an integrated combination of an ink container and an ink jet recording head. Although the cartridge 100 is provided with multiple ink passages, the number of which corresponds to the number of different colors in which the cartridge 100 is capable of printing, FIG. 23, which is a sectional view of the cartridge 100, shows only one ink passage. For descriptive convenience, the section of the ink passage, which extends from the ink inlet opening 105 to a bend 150, will be called section O, and the section of the ink passage, which extends from the bend 150 to bend 160, will be called section P. Further, the section of the ink passage, which extends from the bend 160 to a liquid chamber 108 will be called section Q.

The cartridge 100 has an internal ink storage space 154, and an ink passage 106. The ink passage 106 outwardly extends from the internal ink storage space 154, and is positioned so that when the cartridge 100 is in use, the ink passage 106 extends vertically downward. The ink intake opening 105 of the ink passage 106, which is the interfacial portion between the ink storage space 154 and ink passage 106, is fitted with a filter 104. Further, a substantial portion of the ink storage space 154 is filled with an ink absorbing member 103, which absorbs and internally retains pigment ink 102. The ink passage 106 is shaped like a crank, having two bends, which are the bends 150 and 160, at which the ink passage 106 bends 90 degrees. The ink passage 106 is in connection with the liquid chamber 108, which is on the inward side of a heat radiating member 109, with a joint rubber 107 fitted around the joint between the ink passage 106 and liquid chamber 108. The heat radiating member 109 is provided with a heater board 110, which is fixed to the heat radiating member 109 with the use of unshown adhesive. The heater board 110 is provided with driving elements and ink jetting orifices, which are not shown. The heater board 110 and heat radiating member 109 make up an ink jet recording head 151.

The pigment ink 102 is supplied from the ink absorbing member 103 to the liquid chamber 108 through the ink intake opening 150 and ink passage 106, and is temporarily stored in the liquid chamber 108. The recording head 151 jets the pigment ink 102 from the ink jetting orifices by applying the energy generated by the driving elements, to the pigment ink. As the pigment ink 102 is supplied to the liquid chamber 108, the ambient air enters the ink storage space 154 of the cartridge 100 to compensate for the volumetric loss which could occur to the ink storage space 154 as the pigment ink 102 is supplied from the ink absorbing member 103, were it not for the entry of the ambient air into the ink storage 154.

Normally, as the cartridge 100 is left unused for a certain length of time, the pigment ink in the ink passage 106 and liquid chamber 108 becomes nonuniform in pigment concentration, creating such a pigment concentration gradient that the pigment concentration is lower on top side in terms of the vertical direction, and higher in the bottom portion. Therefore, after the cartridge 100 is left unused for a certain length of time, the pigment concentration gradient of the pigment ink 102 in these sections is such that the section O of the ink passage is lower in pigment concentration and the section Q of the ink passage is higher in pigment concentration. Further, in each of the sections O and Q, the top side is lower in pigment concentration and the bottom side is higher in pigment concentration. The pigment concentration gradient (which hereafter may be referred to as "ink density") of the ink in the horizontal section P, or the section which connects the sections O and Q, is such that the ink density gradually reduces from the bend 150, or the border between the sections O and Q, toward the bend 160, or the border between the section Q and P. As for the density of the body of ink in the section P, which is measured at a given cross-sectional plane of the section P, it is lower in the top side, in terms of the vertical direction, and higher in the bottom side, as it is in the sections O and Q. The reason why the ink density gradient (pigment concentration gradient) changes as described above with the elapse of time is that the pigment is easily affected by gravity, and therefore, is likely to sediment. If the ink in the above described condition is supplied to the recording head 151 to form images, images which are nonuniform in density are formed.

The manner in which the pigment in ink sediments is affected by the type of pigment and the solvent density. In a cartridge which is holding such ink that is high in pigment sedimentation speed, the pigment concentration is rather high in the liquid chamber 108. Further, in the liquid chamber 108, the portion directly under the ink passage 106 is different in ink density (pigment concentration) from the peripheries thereof; in other words, even in the horizontal direction, the pigment ink is nonuniform in density. In some cases, there is a difference of no less than two levels, in terms of an ordinary ink density measurement scale, between the portion of the ink, which is highest in density, and the portion of the ink, which is lowest in density.

Therefore, the abovementioned recovery operation is carried out at a preset interval with the use of a recovery cap with which the recording apparatus is provided. This recovery operation is an operation in which the bubbles and high viscosity ink (ink having increased in viscosity while recording head is left unused) in the recording head 151 are discharged to maintain the ink jetting performance of the recording head 151 at a preset level or higher, and also, to remove the portions of the body of ink in the recording head 151, which have become excessively deviant in density. In the recovery operation, the recovery cap is pressed upon the recording head 151 of the cartridge 100 to hermetically seal the space surrounded by the recovery cap and recording head 151, and then a suction pump connected to the recovery cap is driven to suction out the ink in the ink passage 106 through the ink jetting orifices of the recording head 151. In this recovery operation, the body of ink, which is on the downstream side of the filter 104, is discharged.

As described above, if it is only the recovery operation that is employed to abolish the nonuniformity in the ink density in the ink passage 106, the recovery operation must be very frequently carried out. Further, in the recovery operation, the body of ink, which is significantly nonuniform in density, is removed by discharging the entire body of ink, which is in the section of the ink passage 104, which is on the downstream side of the filter 104. Therefore, the amount by which ink is removed by the recovery operation (amount by which ink is wasted) is substantial, and accordingly, the recording apparatus must be provided with a larger waste ink absorbing member, that is, a waste ink absorbing member, the capacity of which matches the substantial amount by which the ink is wasted. Thus, it is possible that the employment of this method of abolishing the abovementioned excessive nonuniformity in the ink density by the recovery operation will require the main assembly of the recording apparatus to be increased in size.

The cartridge 100, which is a multicolor cartridge, that is, a cartridge capable of forming multicolor images, is more complicated in the shape of the ink passages 106 than a monochromatic, that is, a cartridge dedicated to monochromatic printing. Therefore, the cartridge 100 is greater in the number of sections of the ink passage 106, which are affected by the pigment sedimentation, being therefore greater in the frequency with which the recovery operation has to be carried out, than a monochromatic cartridge. Moreover, the ink passages of the cartridge 100 are generally longer than the ink passage of a monochromatic cartridge, and therefore, the cartridge 100 is greater in the amount by which ink is discharged in the recovery operation than a monochromatic cartridge.

SUMMARY OF THE INVENTION

The present invention was made in consideration of the above described reasons, and its primary object is to provide an ink jet recording head and an ink jet recording apparatus, which are capable of efficiently removing the sedimented ink ingredients.

According to an aspect of the present invention, there is provided an ink jet recording head for ejecting, through an ink ejection outlet, ink introduced through an ink supply port, comprising a first ink flow path in fluid communication with the ink supply port; a second ink flow path which is branched from said first ink flow path at a branch portion and which is in fluid communication with said ink ejection outlet; and a third ink flow path for fluid communication between said branch portion and an outside.

According to the present invention, the ink passage is structured so that the ingredients of pigment ink primarily sediment into the third section of the ink passage through the first section of the ink passage, and the body of ink in the third section of the ink passage, that is, the body of ink, into which the ingredients of pigment ink have sedimented, is removed from the third section. Therefore, the body of ink, into which the ingredients of pigment ink have sedimented, can be efficiently discharged. Thus, the present invention can reduce the amount by which ink must be discharged to eliminate the sedimented ink ingredients. Therefore, not only can the present invention reduce the operational cost of an ink jet recording apparatus, but also, can reduce in volume the waste ink absorbing member for absorbing the discharged ink, making it possible to reduce in size an ink jet recording apparatus.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Embodiment 1

Figure 1:
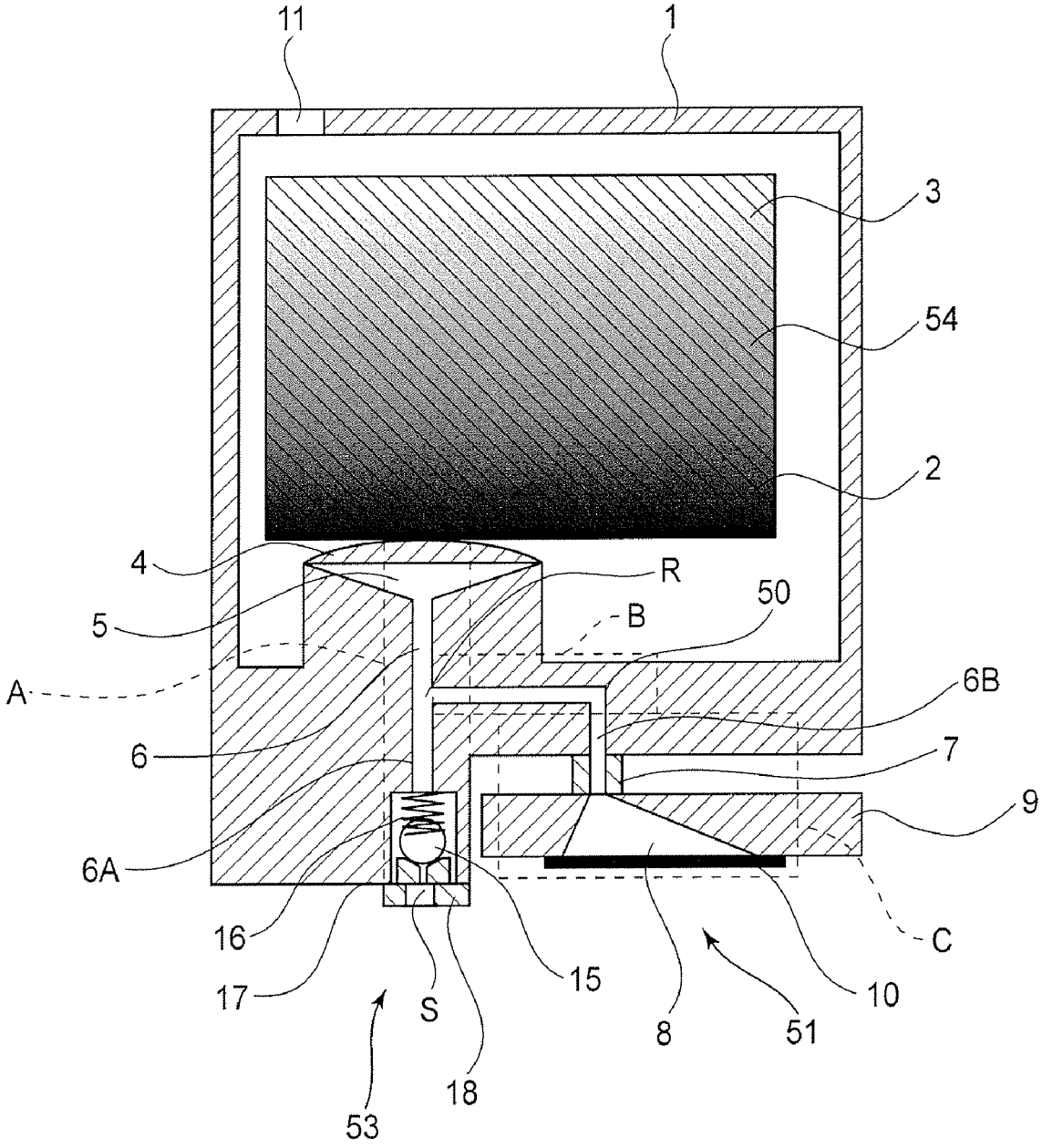
FIG. 1 is a sectional view of the ink jet recording cartridge, in the first embodiment, which is an integral combination of a recording head and an ink container (or containers).

FIG. 1 shows an ink jet recording cartridge 1, in the first embodiment of the present invention, which is an integral combination of an ink jet recording head and one or more ink containers. The ink jet cartridge 1 in this embodiment has: an internal ink storage space 54; an air vent 11 which connects the internal ink storage space 54 and the ambient air; an ink passage which extends outward from the ink storage space 54; and an ink jet recording head 51. The ink passage is provided with an ink intake opening 5, which leads to the ink storage space 54. The ink intake opening 5 is provided with a filter 4. There is an ink absorbing member 3 in the ink storage space 54, and the ink absorbing member 3 absorbs and internally holds pigment ink 2.

In this embodiment, the ink passage has: a section 6 (first ink passage section), which is in connection with the abovementioned ink intake opening 5; a section 6B (section on ink jet recording head side: second section) which branches from the section 6 at a branching point R, and connects to the abovementioned ink jet recording head 51; a section 6A (section on ink ingredient sediment recovery means side: third section), which leads outward. When the cartridge 1 is in the operational attitude (in this embodiment, "operational attitude" is an attitude in which cartridge 1 is after being mounted so that direction in which ink is jetted from its ink jetting orifices is vertically downward), the section 6A extends vertically downward from the branching point R, and the section 6B horizontally extends from the branching point R, bends 90 degrees at a bend 50, and extends vertically downward to the liquid chamber 8. The liquid chamber 8 is on the inward side of a heat radiating member 9, which is in connection with the cartridge 1, with the presence of a joint rubber 7 between the cartridge 1 and heat radiating member 9. The heat radiating member 9 is provided with a heater board 10, which is one of the components of the ink jet recording head 51. The ink jet recording head 51 in this embodiment is made up of the heat radiating member 9 and heater board 10. The section 6B of the ink passage leads into the liquid chamber 8 through the internal passage of the joint rubber 7. The bottom end of the section 6A is sealed by a valve mechanism 53 to prevent ink from leaking therefrom. The valve mechanism 53 is made up of: a ball 15; a coil spring 16; and a ball seat 17 upon which the ball 15 is kept pressed to hermetically seal the interface between the ball 15 and ball seat 17.

Incidentally, in this embodiment, the ball seat 17 is an integral part of a plug 18; the two components are integrally formed by two-color injection molding. The ball seat 17 has a through hole, the axial line of which coincides with the axial line of a through whole S with which the plug 18 is provided. The plug 18 is formed of the same substance as the substance of which the cartridge 1 is formed. The plug 18 is attached to the cartridge 1 by ultrasonic welding, with the presence of no gap between the cartridge 1 and plug 18.

Figure 2:
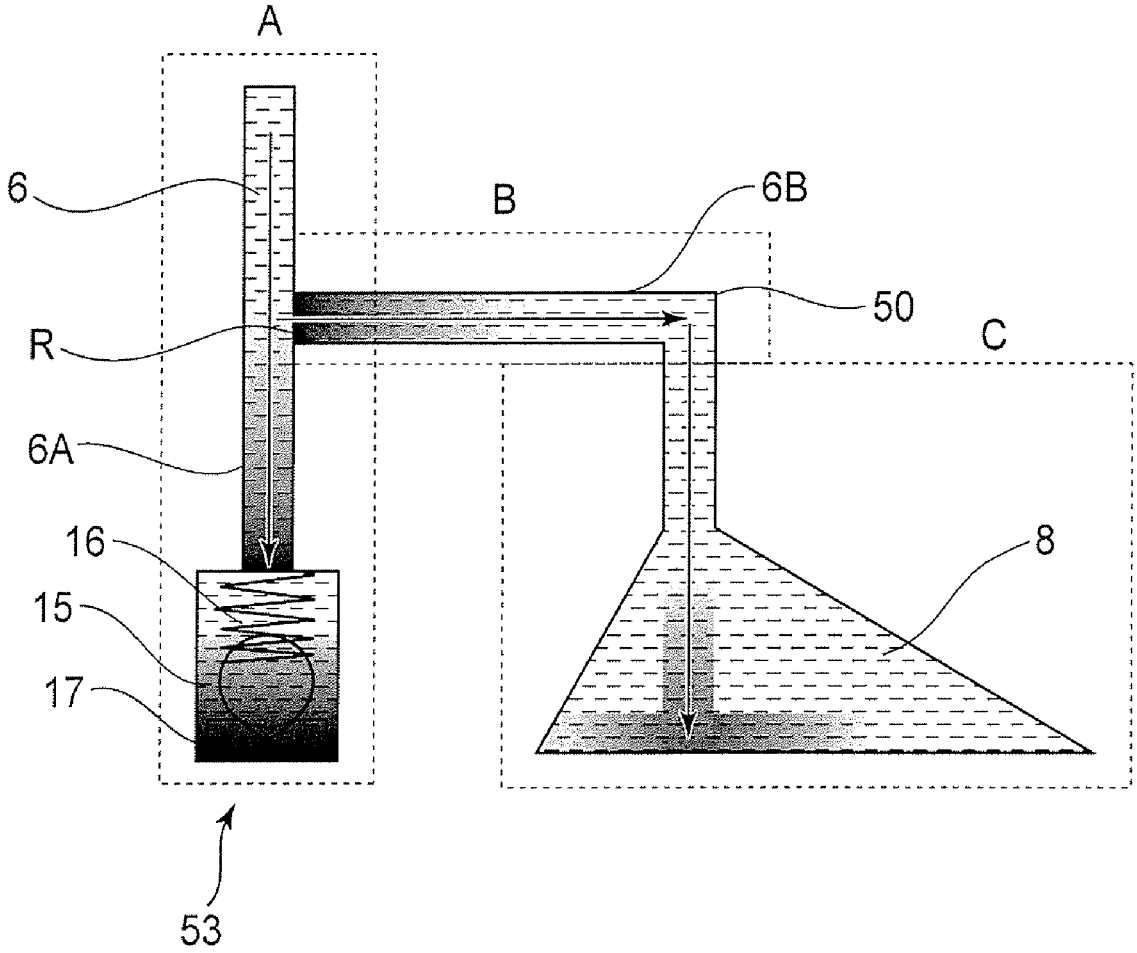
FIG. 2 is an enlarged sectional view of the essential portions of the cartridge shown in FIG. 1.

FIG. 2 shows the condition in which the bodies of ink in the sections of ink passage in areas A, B, and C of the cartridge 1 will be after the cartridge 1 is left unused (undisturbed) for a certain length of time after being mounted into the main assembly of the recording apparatus. The area A includes the section 6 of the ink passage, which extends from the ink intake opening 5 to the branching point, and the section 6A which extends from the branching point to the outlet. The area B is the section of the ink passage which extends from the branching point to the bend 50. The area C includes the section 6B of the ink passage, which extends from the bend 50 to the liquid chamber 8, and the liquid chamber 8. The pigment concentration gradient in the area A is such that the pigment concentration is lower (low concentration) on the top side in terms of the vertical direction, and higher (high concentration) on the bottom side. The pigment concentration gradient of the ink in the area C is the same as that in the area A. In the area B, which is the horizontal area which connects the areas A and C, the pigment concentration gradient is such that the pigment concentration gradually reduces from the branching point R toward the bend 50, that is, from the area A toward the area C. Further, the pigment concentration gradient of the body of ink in the area B, which is measured at a given plane perpendicular to the axial line of the ink passage, is the same as those in the areas A and C, that is, lower (low concentration) on the top side in the vertical direction, and higher (high concentration) on the bottom side. A pigment concentration gradient of ink, such as the above described one, occurs because the pigment sedimentation is greatly affected by gravity.

Referring to FIG. 1, in this embodiment, the ink passage section 6 branches at the branching point R into two passages, that is, the passage (section) 6A, and the passage (section) 6B which is perpendicular to the passage (section) 6A. The section 6A extends vertically downward from the branching point R, making it easier for the pigment in the ink in the section to sediment. The section 6A is provided with the valve mechanism 53, which is made up of the ball 15, coil spring 16, and ball seat 17, as described above.

Figure 3:
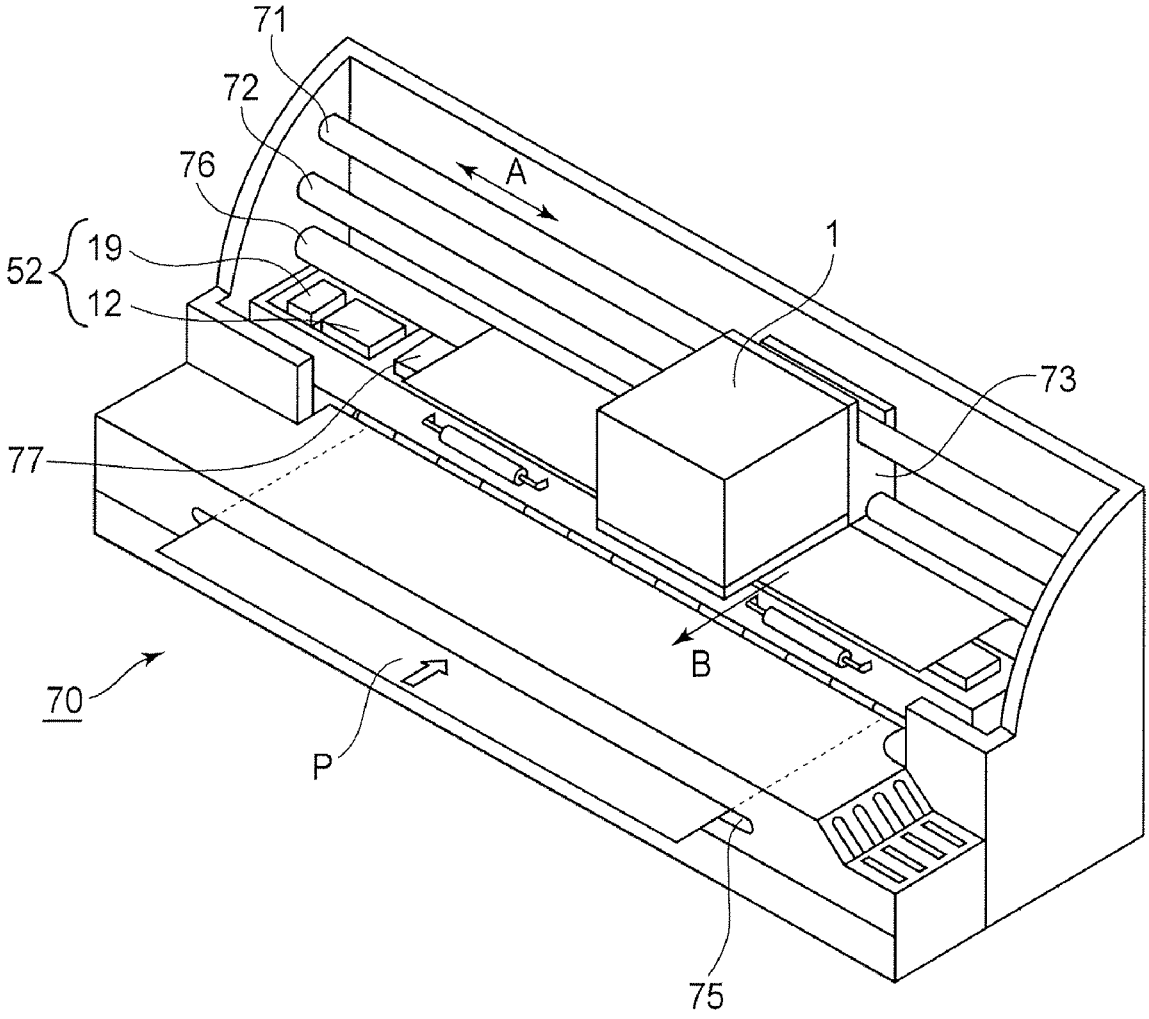
FIG. 3 is a perspective view of a typical ink jet recording apparatus in which the cartridge shown in FIG. 1 is mountable.

FIG. 3 is a perspective view of a recording apparatus 70 in which the cartridge 1 is mountable, and shows the general structure of the recording apparatus 70. The recording apparatus 70 is a recording apparatus of the serial scan type, which has a pair of guiding shafts 71 and 72, and a carriage 73 on which the cartridge 1 is mountable. The carriage 73 is supported by the pair of guiding shaft 71 and 72, being enabled to move in the primary scan direction indicated by an arrow mark A. The carriage 73 is reciprocally moved in the above-mentioned primary scan direction by a driving force transmitting mechanism made up of a carriage motor, a belt for transmitting the driving force of the carriage motor, etc. A sheet of paper P as a medium on which recording made is inserted into the main assembly of the recording apparatus 70 through a recording medium inlet 75 located on the front side of the apparatus main assembly, and is conveyed by a recording medium conveyance roller 76 through the apparatus main assembly in the secondary scan direction indicated by an arrow mark B. Before the leading edge of the paper P reaches the cartridge 1 on the carriage 73, the paper P is curved so that the leading portion of the paper P move in the opposite direction from the direction in which the paper P is inserted into the apparatus main assembly.

An image is formed in sections on the paper P by alternately repeating the recording operation and conveying operation. In the recording operation, the recording head 1 is made to jet ink toward the printing area of the paper P on a platen 7, while moving the carriage 1, on which the cartridge 1 is borne, in the primary scan direction. In the conveying operation, the paper P is conveyed in the secondary scan direction by a distance equal to the width of each section of the image which is being recorded each time the carriage 1 is moved in the primary direction during the recording operation. The recording apparatus 70 is provided with a recovery cap mechanism 52, which is positioned at the left end of the moving range of the carriage 73, shown in FIG. 3, so that when the carriage 73 is at the left end of its moving range, the recovery cap mechanism opposes the surface of the recording head 51 of the cartridge 1 on the carriage 73, which has the opening of each ink jetting orifice.

The pigment ink 2 is supplied from the ink absorbing member 3 to the ink chamber 8 through the ink intake opening 5 and ink passage sections 6 and 6B, and is temporarily stored in the ink chamber 8. The recording head 51 jets the pigment ink 2 through its ink jetting orifices by applying to the pigment ink the ink jetting energy which it generates by its driving elements. The ink jetting energy can be supplied with the use of an electrothermal transducer (heater), a piezoelectric element, or the like. When an electro-thermal transducer is employed, the ink is made to boil by the heat generated by the electro-thermal transducer, and the energy generated by the boiling of the ink is used to jet the ink from the ink jetting orifices of the recording head 51. As the pigment ink is supplied to the recording head 51 as described above, the cartridge 1 takes in the ambient air through its air vent 11 to compensate for the void which would be created in the ink absorbing member 3 as the pigment ink 2 is supplied from the ink absorbing member 3, if the ambient air were not taken in.

Figure 4:
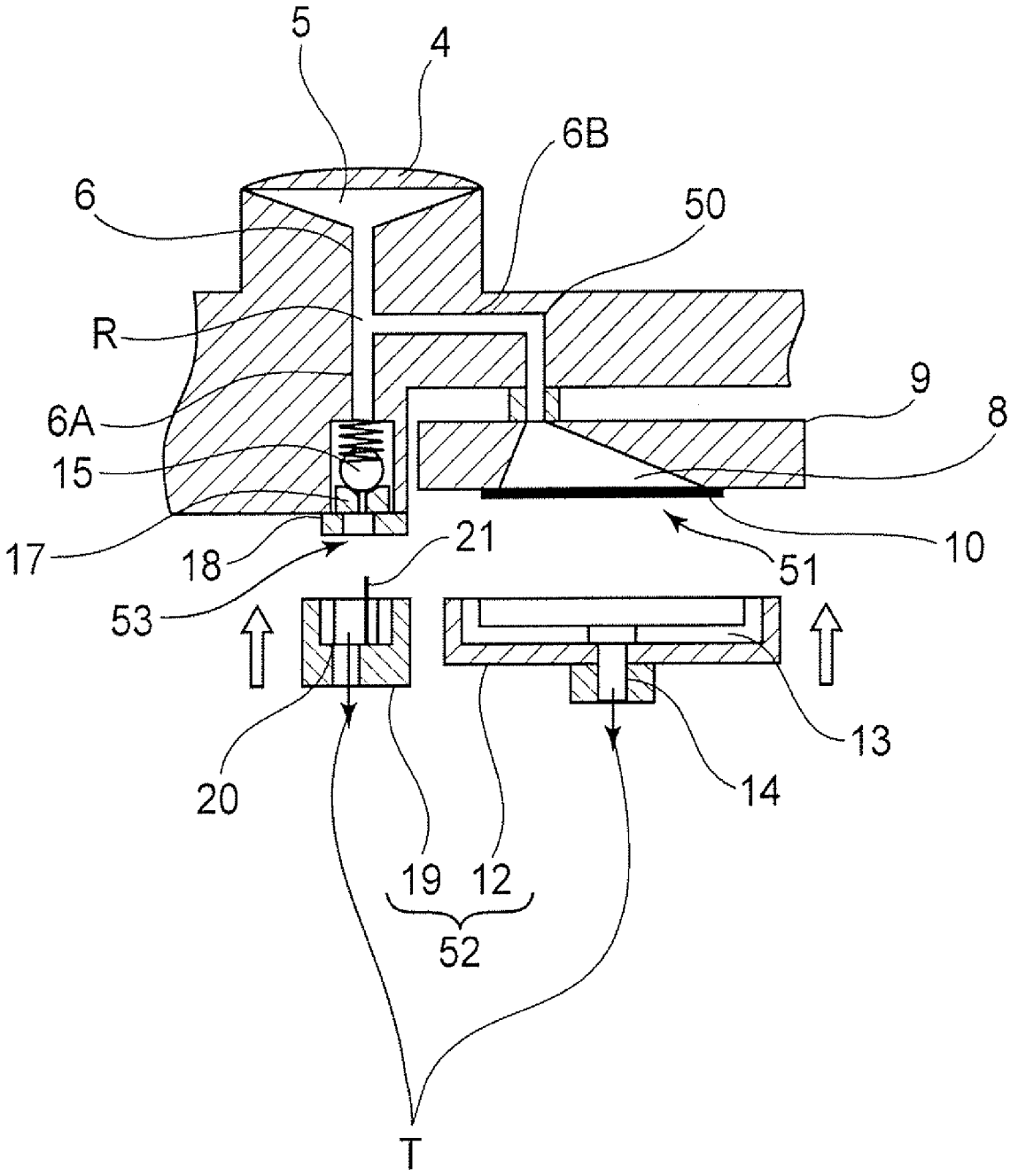
FIG. 4 is a sectional view of the cartridge shown in FIG. 1, and the recovery cap for the cartridge.

FIG. 4 is an enlarged sectional view of the recovery cap mechanism 52 used in the recovery operation, which is an operation for recovering the performance of the recording head 51 by suctioning out the ink in the recording head 51, and its adjacencies, and shows the structure of the recovery cap mechanism 52. The recovery cap mechanism 52 has a pair of caps 12 and 19, which are in connection with a suction pump. The cap 12 is for suctioning out the ink in the cartridge 1 through the ink jetting orifices of the recording head 51. The cap 19 is for suctioning out the ink in the cartridge 1 through the section 6A of the ink passage. The cap 19 has a sealing member 20, which is for sealing the joint between the bottom end of the ink passage section 6A and the cap 19. The cap 19 is also provided with a projection 21 which projects beyond the top surface of the cap 19, which comes into contact with the cartridge 1. The cap 12 is provided with a discharge hole 13, which is in connection with a discharge tube 14.

Next, the operation for recovering the performance of the cartridge 1 by suctioning out the ink in the cartridge 1 will be described. It is assumed that before the recovery operation is carried out, the cartridge 1 has been left unused (undisturbed) for a long time, and therefore, the pigment in the bodies of ink in the areas A, B, and C of the cartridge 1 has sedimented. It is the bottom portion of the area A that has become highest in the pigment concentration. There are pigment particles which have accumulated in this portion of the area A. In the recovery operation, therefore, ink is suctioned out from this portion, or the bottom portion of the area A.

Figure 5:
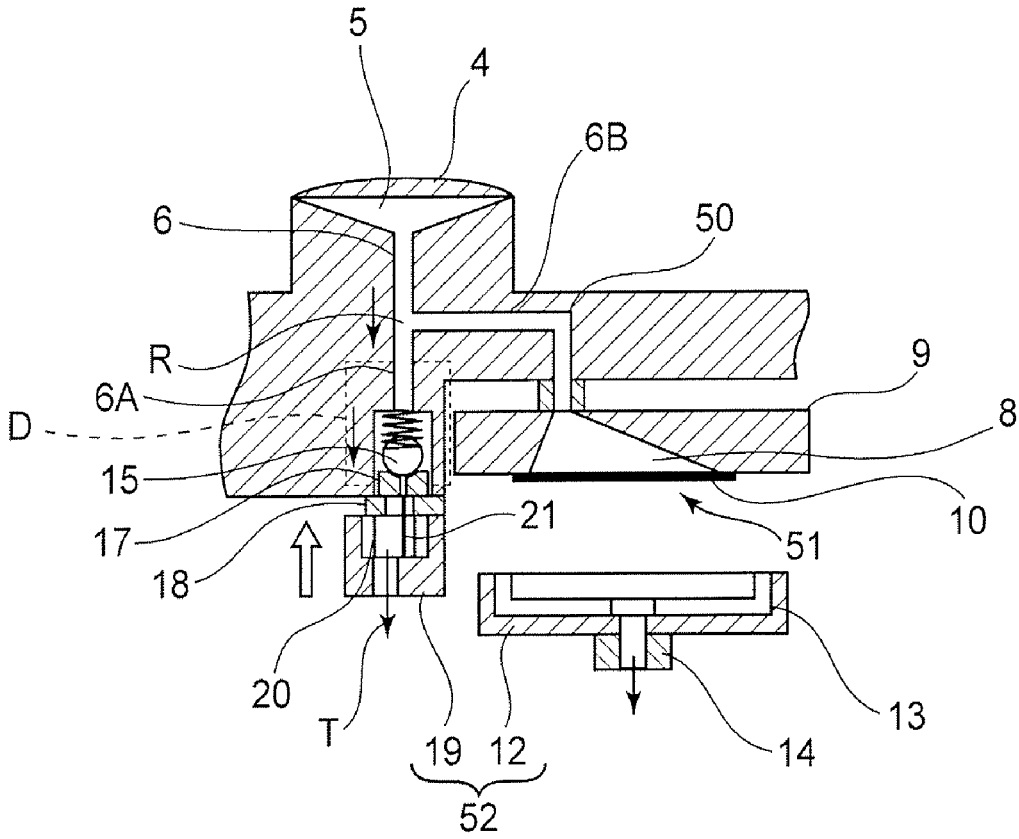
FIG. 5 is a sectional view of the recovery caps for the cartridge shown in FIG. 1, and the essential portions of the cartridge, which are involved in the recovery operation, showing one of the steps in the recovery operation.

Referring to FIG. 5, next, the cap 19 is pressed on the cartridge 1 so that the sealing member 20 is placed hermetically in contact with the area of the bottom surface of the cartridge 1, which surrounds the bottom opening of the section 6A of the ink passage. During this step, the projection 21 of the cap 19 enters the section 6A beyond the plug 18 and ball seat 17, while pushing up the ball 15. As a result, the ball 15 is separated from the ball seat 17, creating a gap, between the ball 15 and ball seat 17, through which ink can flow.

Figure 6:
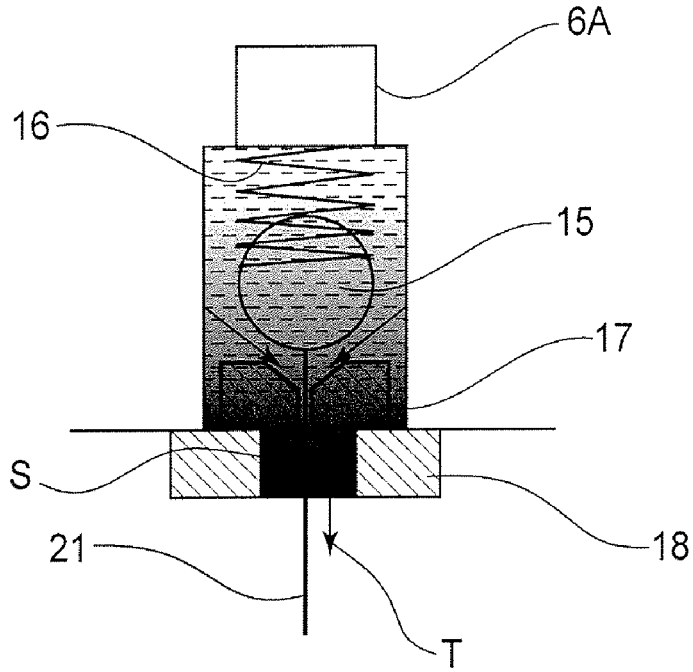
FIG. 6 is an enlarged sectional view of the valve mechanism shown in FIG. 5.

The cap 19 is in connection with an unshown suction pump (vacuum pump) to generate negative pressure in the cap 19. Next, referring to FIG. 6, as the suction pump is driven, the ink in the section 6A is suctioned into the cap 19. That is, the body of ink in the bottom portion of the section 6A, into which the pigment particles have sedimented, is suctioned in the direction indicated by an arrow mark T. The amount by which the ink is suctioned out can be optimized, and also, minimized, by setting the amount according to the length of time the recording apparatus has been continuously left unused. After the preset amount of ink is suctioned out, the cap 19 is separated from the cartridge 1.

Figure 7:
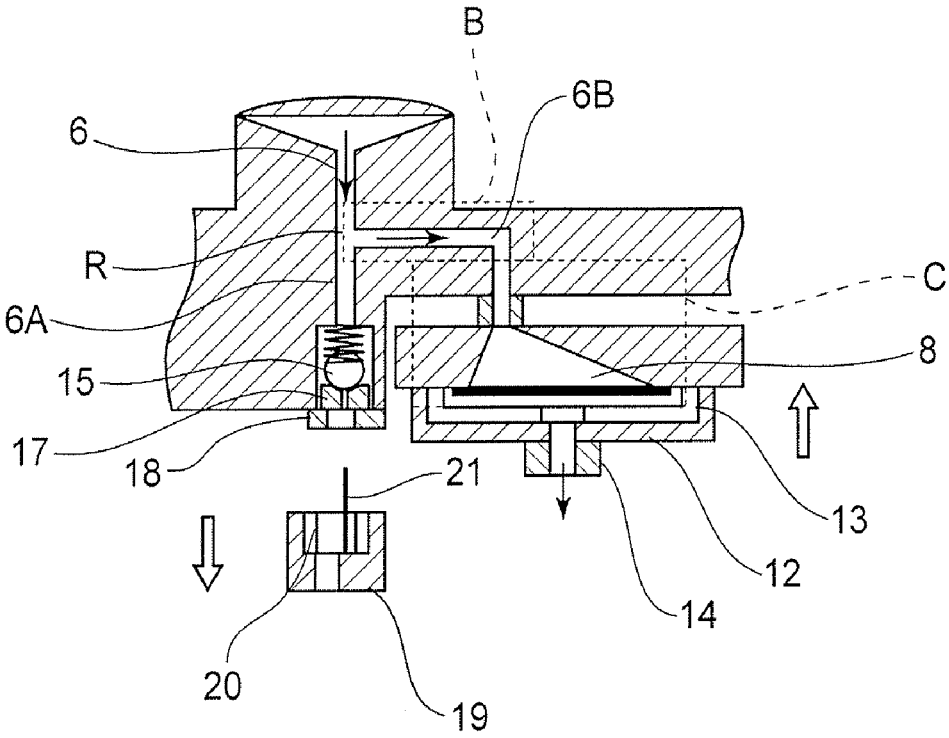
FIG. 7 is a sectional view of the recovery cap for the cartridge shown in FIG. 1, and the essential portions of the recording head of the cartridge, which are involved in the recovery operation, showing another step in the recovery operation.

Referring to FIG. 7, next, the cap 12 is pressed upon the recording head 51, whereby the space surrounded the recovery cap 12 and recording head 51 is hermetically sealed. The discharge tube 14 of the cap 12 is in connection with an unshown suction (vacuum) pump. As soon as the cap 12 becomes connected to the recording head 51, the suction pump is driven to suction out ink from the recording head 51 by an amount large enough to remove the sedimented ink ingredients and the lingering bubbles in the areas B and C. As ink is suctioned out of the recording head 51, it is discharged outward from the cap 12 through the discharge hole 13 and discharge tube 14, and then, is sent to the waste ink absorbing member in the recording apparatus. As soon as the process of suctioning ink out of the recording head 51 is completed, the cap 12 is retracted (separated) from the recording head 51 (cartridge 1).

The caps 12 and 19 are placed in contact with, or separated from, the cartridge 1 by a mechanical driving means in the recording apparatus. In this embodiment, the caps 12 and 19 can be advanced toward, or retracted from, the cartridge 1, independently from each other. In other words, the caps 12 and 19 are individually driven.

In this embodiment, the body of high density ink (high in pigment concentration) in the area D shown in FIG. 5, that is, the body of ink into which the pigment has sedimented, is discharged by suctioning the ink in the cartridge 1 through the ink passage sections 6 and 6A (for convenience, this process may be simply stated as "process of suctioning ink from ink passage section 6A"). Then, the bodies of ink in the areas B and C, which are high in density (pigment concentration) and contain the bubbles, are removed by suctioning the ink in the cartridge 1 through the ink passage section 6 and 6B (for convenience, this process may be referred to as "process of suctioning ink from ink passage 6B"). The amount by which ink is to be suctioned out when removing the ink in the section 6B has only to be just enough to remove the sedimented ink ingredients in the areas B and C, because the sedimented ink ingredients in the area A are removed before the ink in the section 6B is suctioned out. Therefore, unlike in the past, it is unnecessary to remove all the ink in the areas on the downstream side of the filter 4. In other words, compared to the amount by which ink has to be suction out according to the prior art, the amount by which ink has to be suction out of the ink cartridge 1 in this embodiment is smaller by an amount equal to the amount of ink in the top portion of the area A, that is, the body of ink which does not need to be removed, because the pigment had not sedimented in this body of ink. Therefore, this embodiment is smaller in the amount of waste ink, and therefore, the waste ink absorbing member in the recording apparatus may be smaller. Thus, this embodiment makes it possible to reduce the recording apparatus in size.

Described below are the sequential steps in the recovery operation for removing the sedimented ink ingredients with the use of the cap 19.

1) The sealing member of the cap 19 is pressed on the plug 18 to hermetically seal the space surrounded by the sealing member 20, and the area of the bottom surface of the cartridge 1, which is next to the bottom opening of the ink passage section 6A.

2) The projection 21 which extends from within the sealing member 20 reaches beyond the opening S of the plug 18, and comes into contact with the ball 15.

3) The cap 19 is to be pressed hard enough for the projection 21 to push upward the ball 15 away from the ball seat 17.

4) Negative pressure is generated in the cap 19 to suction ink by a preset amount in the direction indicated by an arrow mark T.

5) After the removal of the preset amount of ink, the cap 19 is moved in the direction (downward) to remove the pressure applied to the cartridge 1 by the cap 19.

Figure 8:
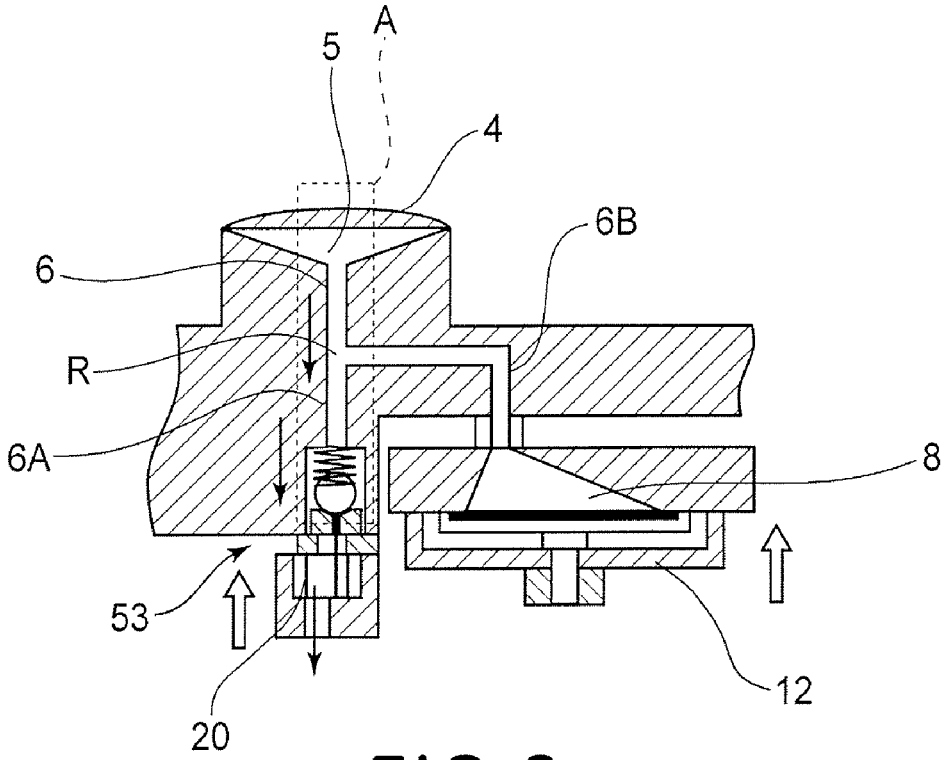
FIG. 8 is a sectional view of the recovery cap for the cartridge shown in FIG. 1, and the essential portions of the cartridge, which are involved in the recovery operation, showing the state of the cartridge, in which the two recovery caps are kept pressed on the cartridge.
Figure 9:
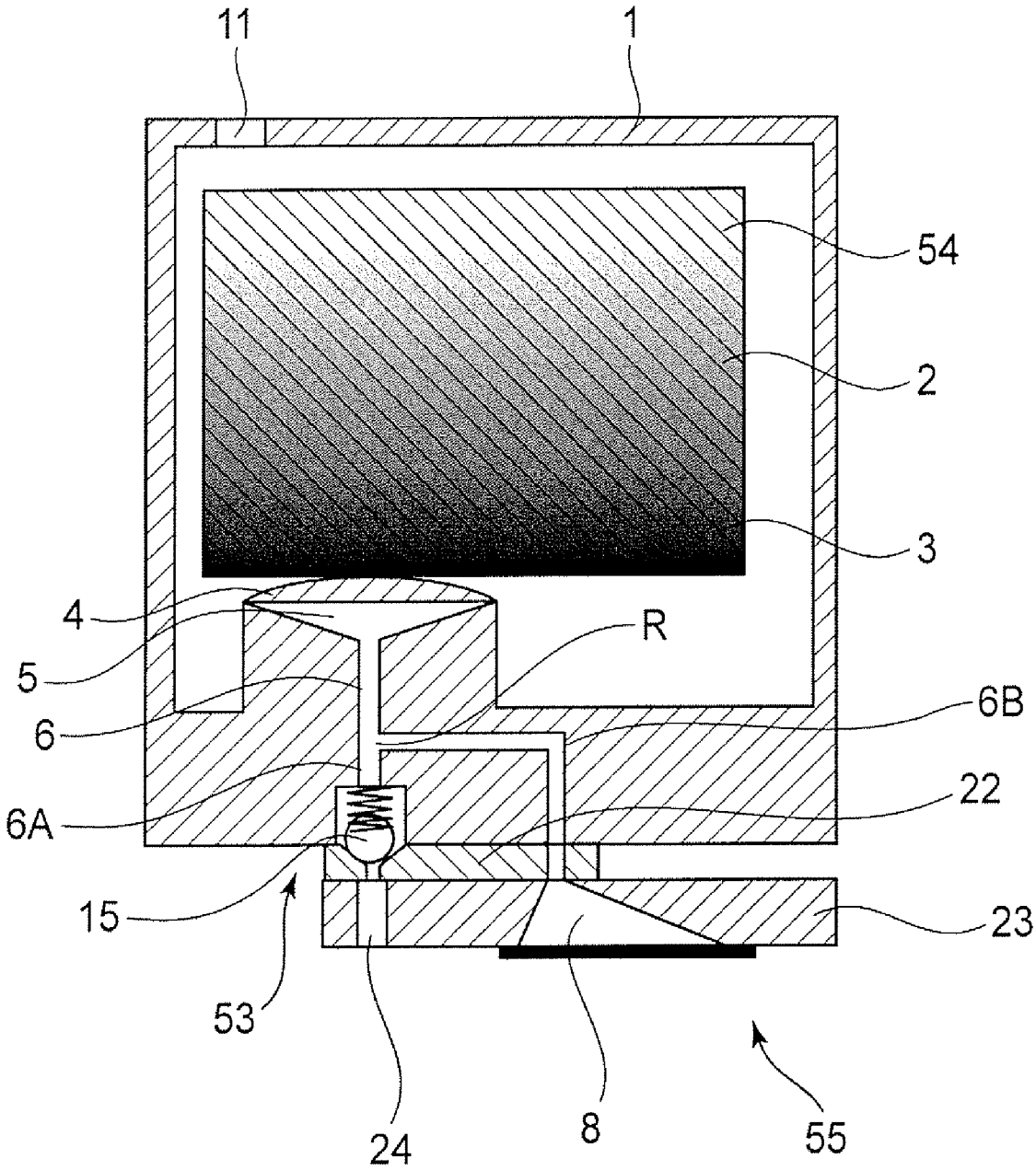
FIG. 9 is a sectional view of the ink jet recording cartridge, in the second embodiment, which is an integral combination of a recording head and an ink container (or containers).

Incidentally, in the above described embodiment, ink is suctioned out of the ink passage section 6A while keeping the cap 12 pressed upon the cartridge 1, and thereafter, ink is suctioned out from the ink passage section 6B while keeping the cap 19 pressed upon the cartridge 1. However, it is acceptable to suction ink out of the ink passage section 6A while keeping both the caps 12 and 19 pressed upon the cartridge 1, and thereafter, suction ink out of the ink passage section 6B. Shown in FIG. 8 is the state of the cartridge 1 and caps 12 and 19, in which both caps 12 and 19 are kept pressed upon the cartridge 1 to keep hermetically sealed the spaces surrounded by the caps 12 and 19 and the corresponding areas of the cartridge 1. In this case, when ink is suctioned out of the ink passage section 6A with the use of the cap 19, the sedimented ink ingredients in the area D can be more efficiently suctioned out, because the ink jetting orifices of the recording head 51 are kept sealed by the cap 12. After ink is suctioned out of the ink passage section 6A as shown in FIG. 8, the cap 19 is separated from the cartridge 1 as shown in FIG. 7. Then, the ink in the areas B and C are suctioned out through the cap 12 (by generating negative pressure in the cap 12).

Embodiment 2

Next, referring to FIGS. 9-12, the second preferred embodiment of the present invention will be described. Incidentally, the components in this embodiment, which are identical to the counterparts in the first embodiments are given the same referential symbols as those given to the counterparts, and will not be described; only the components in this embodiment, which are not identical to the counterparts in the first embodiment, or not present in the first embodiment, will be described. In this embodiment, a heat radiating member 23, which is the counterpart of the heat radiating member 9 in the first embodiment, is provided with a through hole 24. Further, a sealing member 22 in this embodiment is made wider than the sealing member 22 in the first embodiment, and also, is shaped so that it can seal between the heat radiating member 9 and cartridge 1 around both the openings of the ink passage sections 6A and 6B. An ink jet recording head 55, or the ink jet recording head in this embodiment, is structured to be compatible with the heat radiating member 23. The employment of this structural arrangement makes it possible to eliminate the plug 18, which was necessary in the first embodiment. Thus, it can eliminate the process for welding the plug 18 to the cartridge 1.

Figure 10:
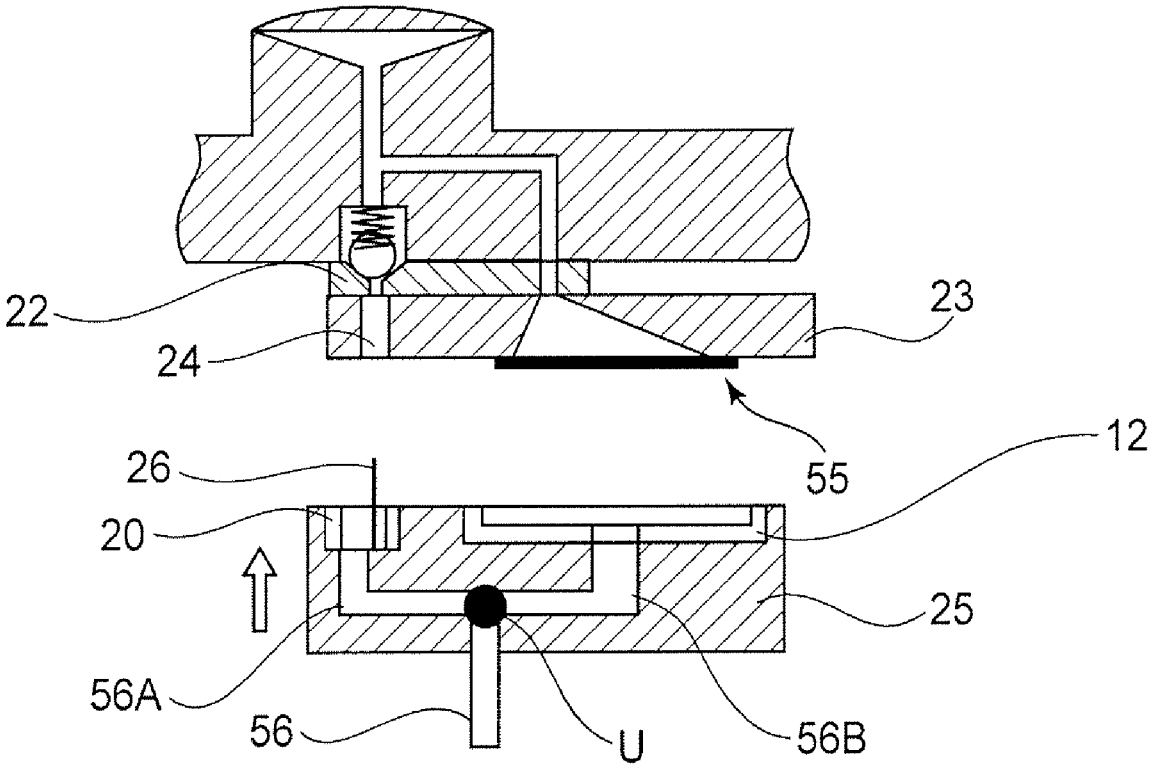
FIG. 10 is a sectional view of the cartridge and recovery cap shown in FIG. 9.

Shown in FIG. 10 are a cap 25, that is, the cap in this embodiment, used for the recovery operation, and the recording head 55.

The cap 25 is an integral combination of the caps 12 and 19 used in the first embodiment. The cap 25 has a projection 26 which projects from the inward side of the sealing member 20. Incidentally, the projection 26, which is equivalent to the projection 21 used in the first embodiment, is longer than the projection 21, by the length equal to the thickness of the heat radiating member 23. Further, the cap 25 has two ink passage sections 56A and 56B, through which ink is suctioned out. The two ink passages sections 56A and 56B of the cap 25 correspond to the ink passage sections 6A and 6B of the cartridge, respectively. The ink passage sections 56A and 56B are separated by a three way valve U. The provision of the three way valve U between the two ink passage sections 56A and 56B of the cap 25 makes it possible to switch between the two ink passage sections 56A and 56B when suctioning ink.

Figure 11:
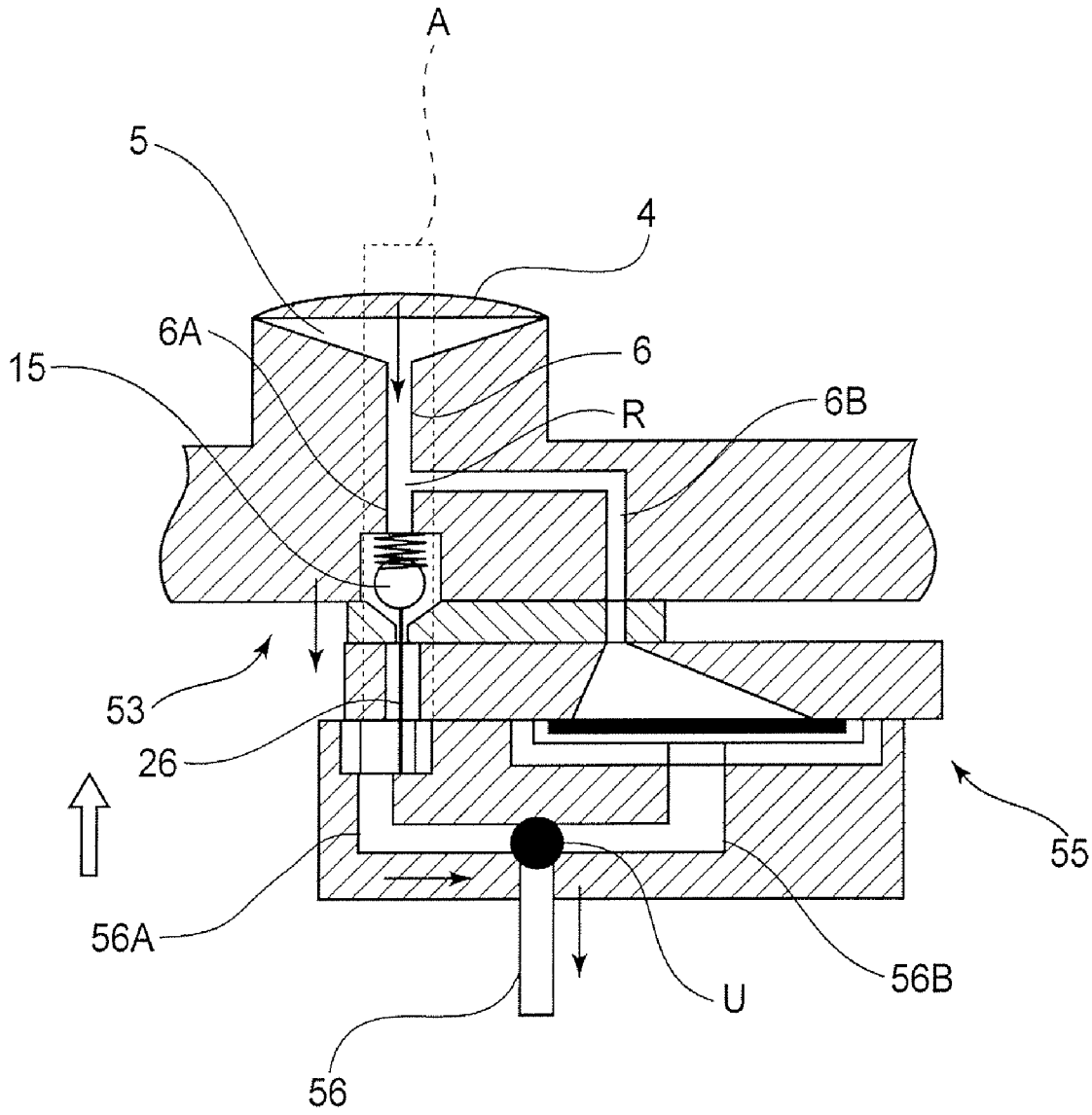
FIG. 11 is a sectional view of the recovery cap for the cartridge shown in FIG. 9, and the essential portions (ink passage) of the cartridge, which are involved in the recovery operation, showing one of the steps in the recovery operation.

FIG. 11 shows the state of the cap 25 and recording head 55, in which the recovery operation is being carried out, with the cap 25 kept pressed on the recording head 55 so that the spaces formed by placing the cap 25 in contact with the recording head 55 remains hermetically sealed. As the cap 25 is pressed on the recording head 55 hard enough to keep the abovementioned spaces hermetically sealed, the projection 26 causes the ball 15 to separate from the sealing member 22. In the recovery operation in this embodiment, first the three way valve U is turned so that the ink passage section 6A becomes connected to the ink suctioning side, and the ink in the area A is suctioned out. In this step of the recovery operation, the body of ink in the area A, that is, the body of ink, in which the sedimentary ink ingredients had accumulated, is removed.

Figure 12:
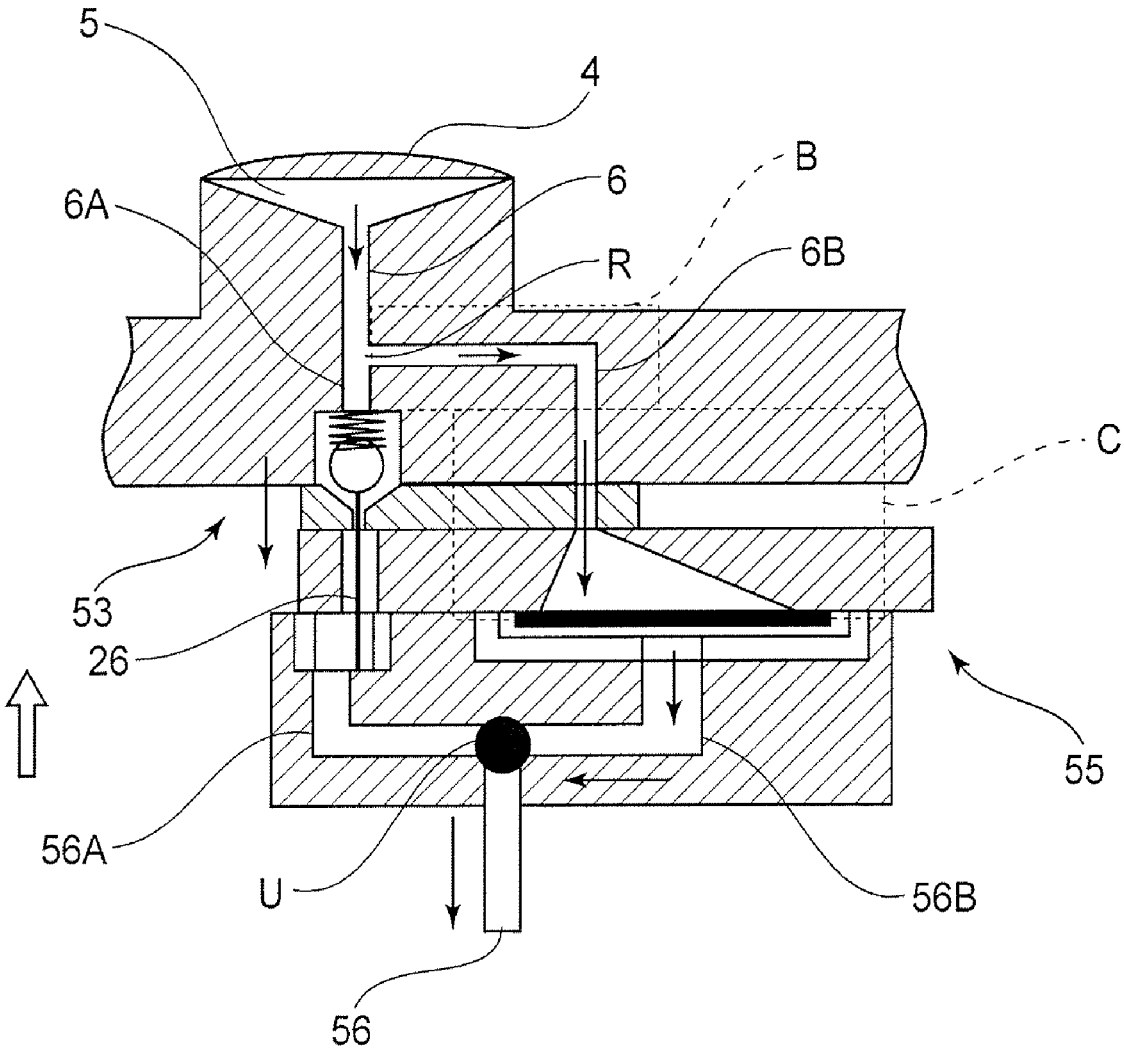
FIG. 12 is a sectional view of the recovery cap for the cartridge shown in FIG. 9, and the essential portions of the cartridge, which are involved in the recovery operation, showing another step in the recovery operation.
Figure 13:
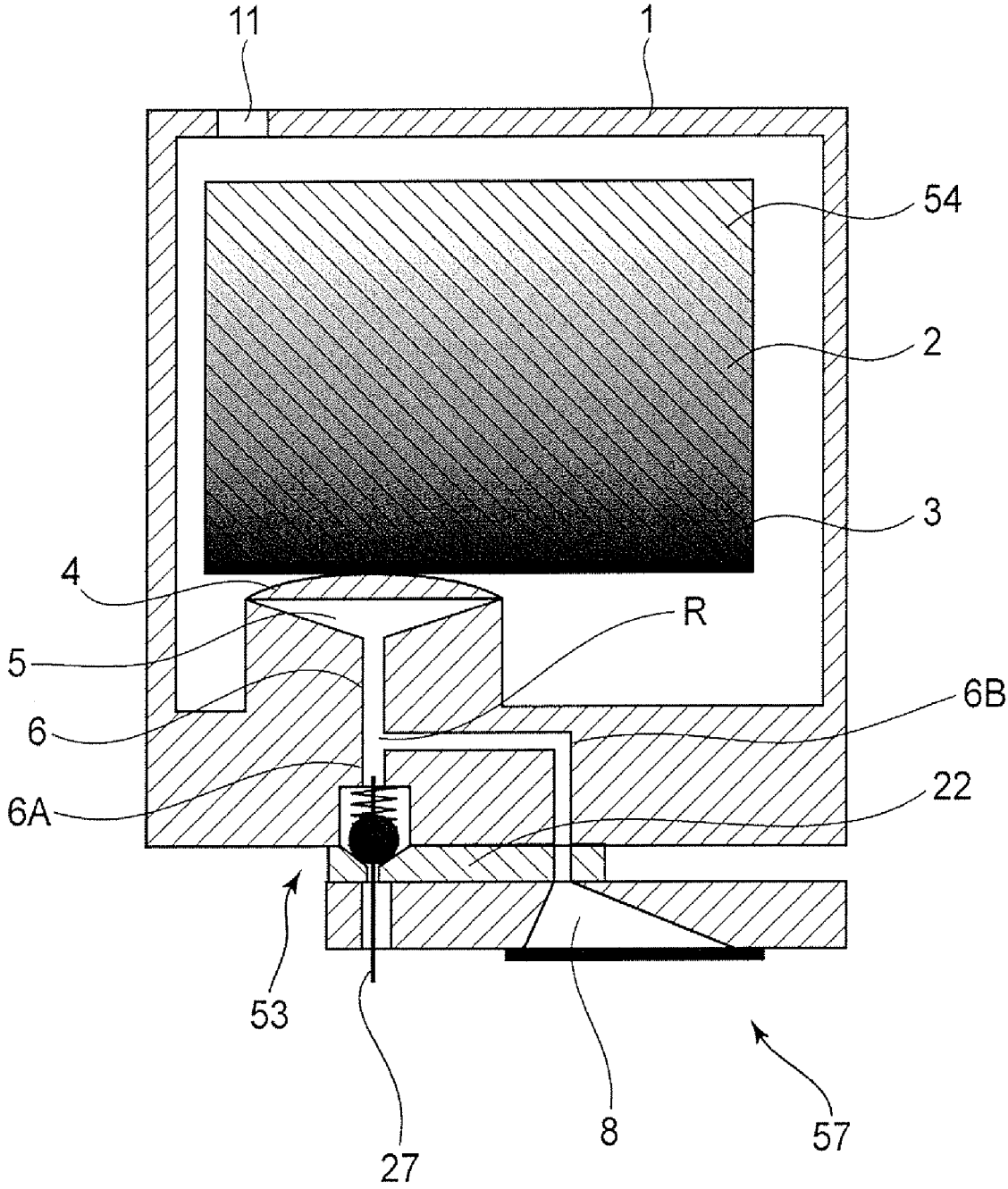
FIG. 13 is a sectional view of the ink jet recording cartridge, in the third embodiment, which is an integral combination of a recording head and an ink container (or containers).

Next, referring to FIG. 12, the three way value U is turned to connect the ink passage section 6B to the side from ink is suctioned, while keeping the cap 25 pressed on the recording head 55. Then, the bodies of ink in the areas B and C are suctioned out, whereby the sedimented ink ingredients are removed from the areas B and C, and also, the bubbles lingering in the ink passage section 6B are removed.

The cap 25, that is, the recovery cap in this embodiment, is more complicated than the recovery caps in the first embodiment. However, the cap 25 is an integral combination of the two caps 12 and 19 required in the first embodiment. In other words, the cap 25 replaces the two caps 12 and 19 which were required in the first embodiment. Therefore, the employment of the cap 25 makes it unnecessary to individually advance or retract multiple (two) caps; only one cap driving means, that is, the driving means for driving the cap 25, is necessary. Further, the cap 25 has to be advanced once and retracted once per recovery operation. Therefore, this embodiment is smaller in the number of times a capping means has to be driven (number of times cap 25 has to be driven) per recovery operation. Therefore, this embodiment is smaller in the amount of the load for driving the cap than the first embodiment.

Embodiment 3

Next, referring to FIGS. 13-16, the third embodiment of the present invention will be described. Incidentally, the components in this embodiment, which are identical to the counterparts in the first or second embodiment are given the same referential symbols as those given to the counterparts, and will not be described; only the components in this embodiment, which are not identical to the counterparts in the first or embodiment, or not present in the first or second embodiment, will be described. In this embodiment, a slidable pin 27 is provided in place of the ball 15 employed in the second embodiment. The slidable pin 27 is made up of a ball portion, such as the ball 15 in the second embodiment, and a projection portion, such as the projection 26 in the second embodiment. Thus, the valve mechanism is opened or closed by the slidable pin 27.

Figure 14:
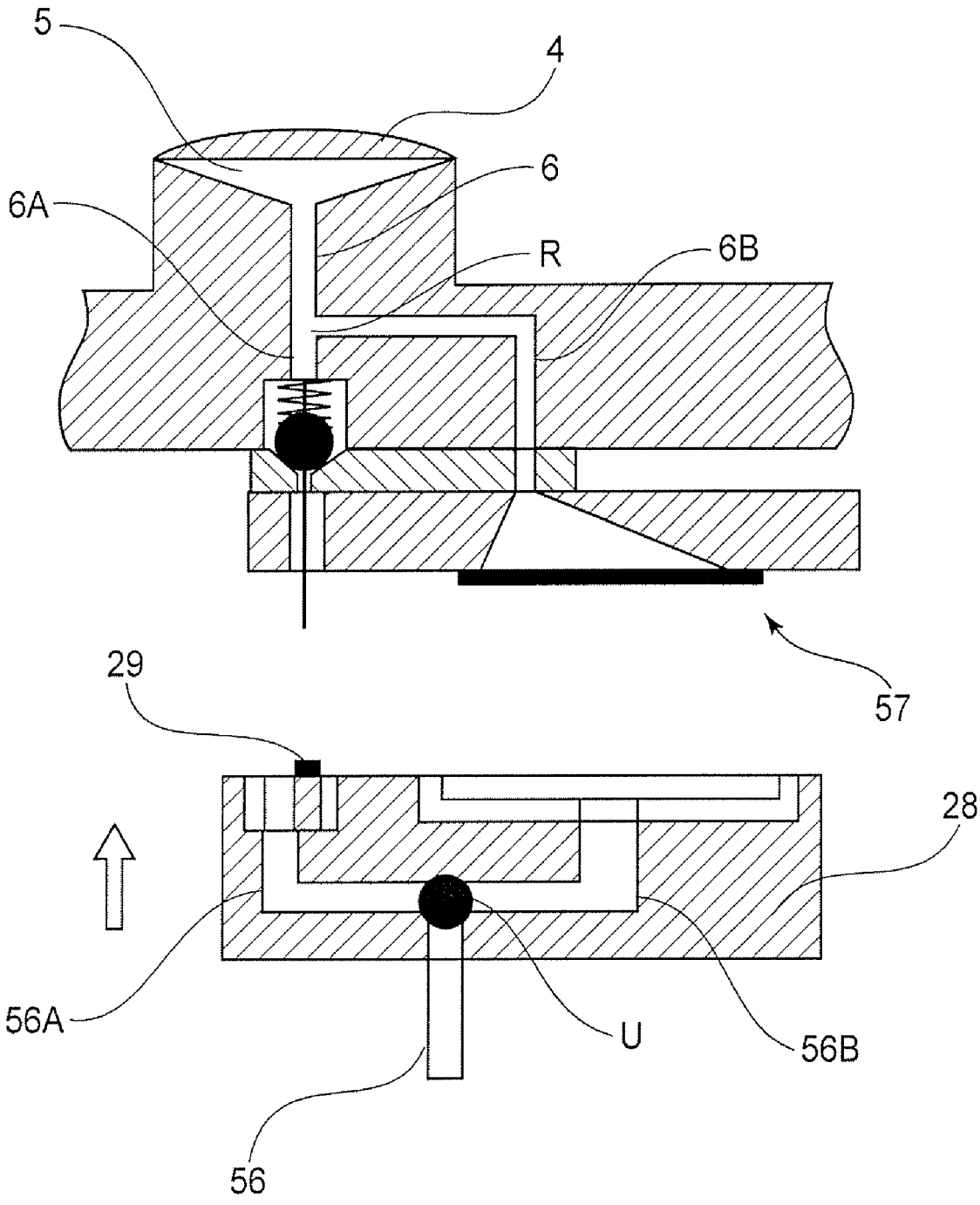
FIG. 14 is a sectional view of the cartridge and recovery cap shown in FIG. 13.

FIG. 14 shows a cap 28, that is, a cap in this embodiment, will be described. The cap 28 is provided with a plate 29 which comes in contact with the slidable pin 27. As the cap 28 is pressed on a recording head 57, which is a recording head in this embodiment, to hermetically seal the space formed between the cap 28 and recording head 57, the plate 29 presses on the slidable pin 27, causing thereby the slidable pin 27 to be separated from the sealing member 22. The plate 29 is rigid enough not to deform when it presses on the slidable pin 27.

Figure 15:
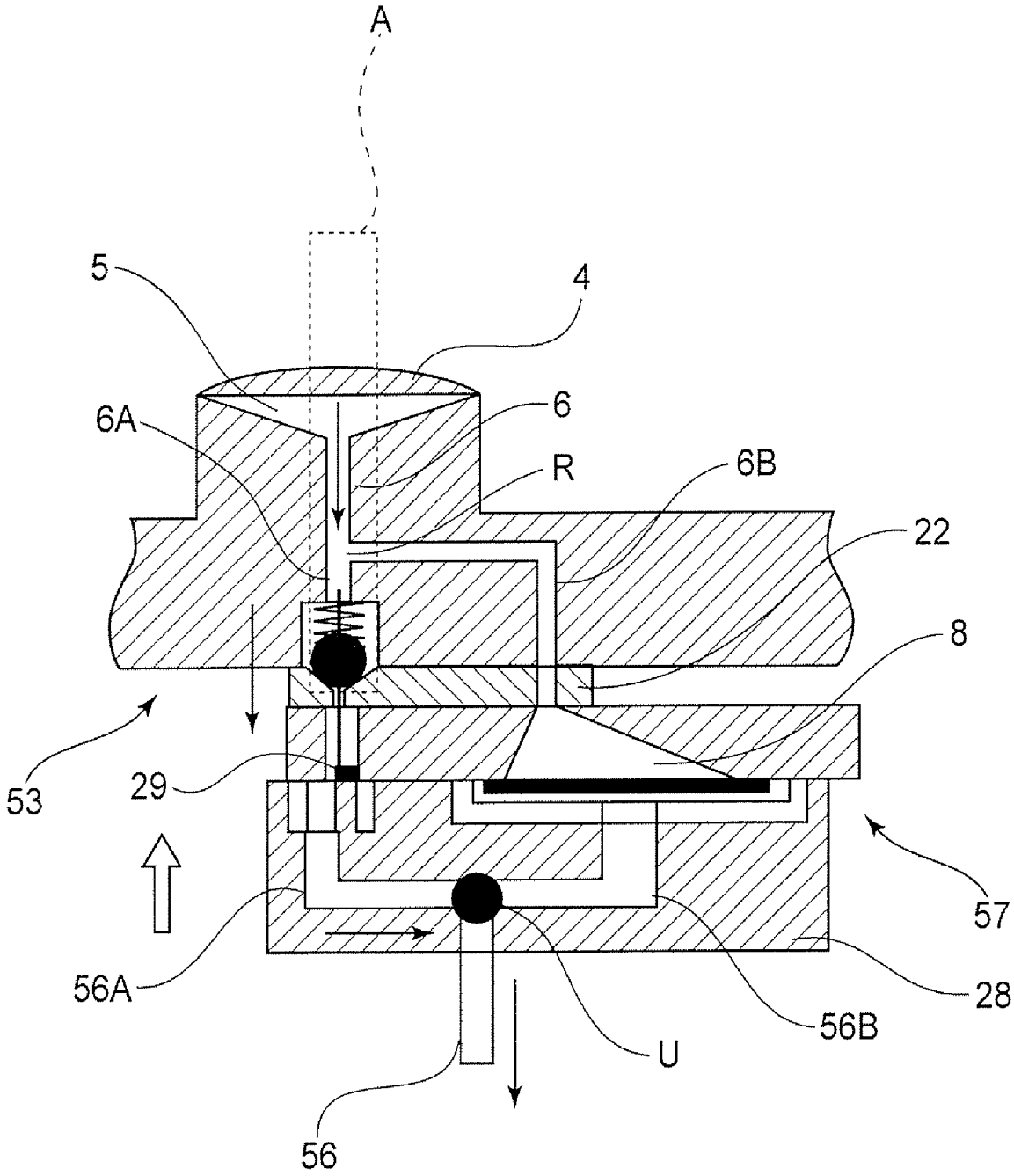
FIG. 15 is a sectional view of the recovery cap for the cartridge shown in FIG. 13, and the essential portions (ink passage) of the cartridge, which are involved in the recovery operation, showing one of the steps in the recovery operation.
Figure 16:
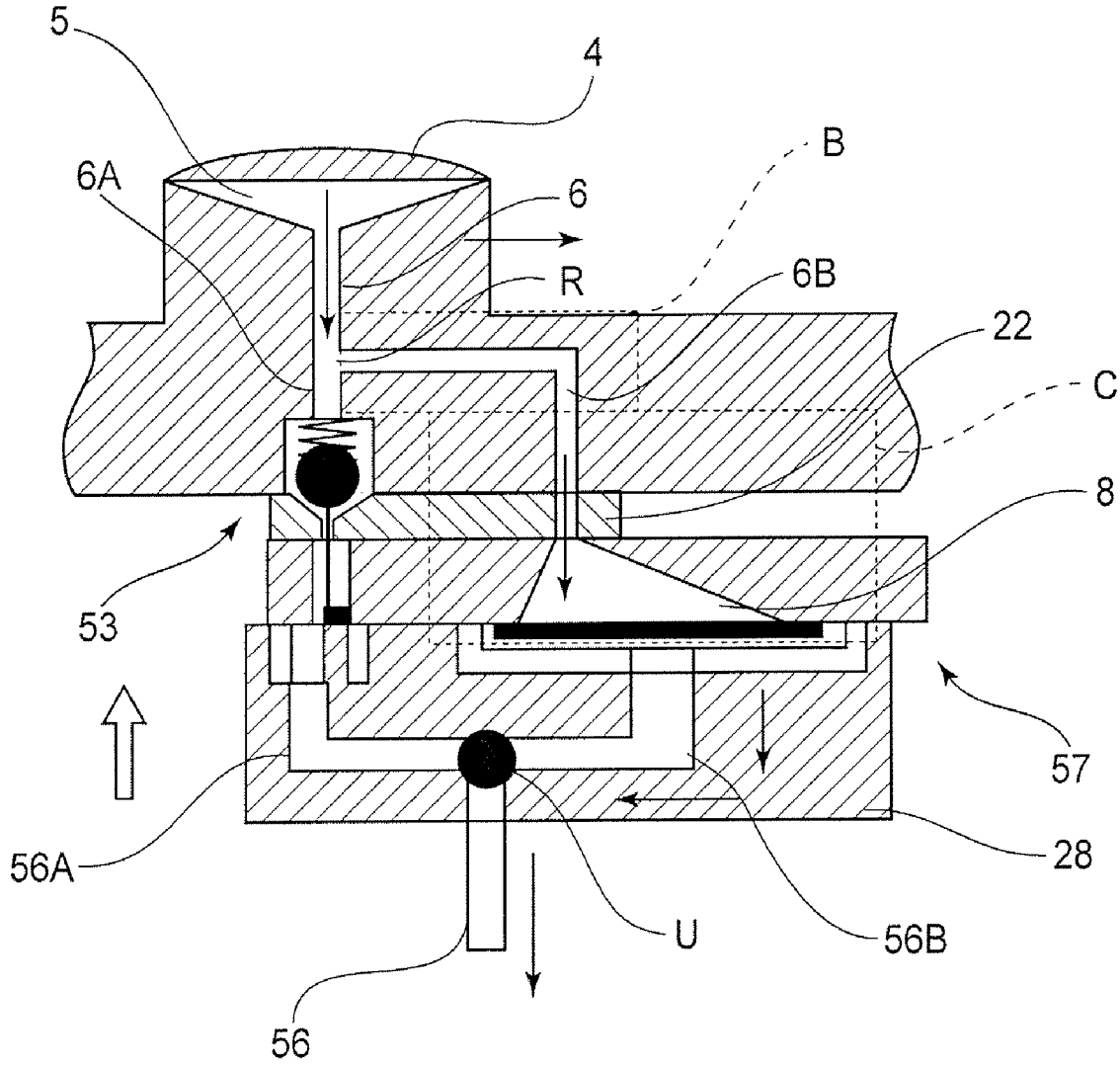
FIG. 16 is a sectional view of the recovery cap for the cartridge shown in FIG. 13, and the essential portions of the cartridge, which are involved in the recovery operation, showing another step in the recovery operation.

The recover operation in this embodiment, which uses the cap 28, is the same as the recovery operation in the second embodiment. FIG. 15 shows the state of the cartridge 1 and cap 28, in which the ink is being suctioned out of the ink passage section 6A in order to suction out the body of ink in the area D, which is high in pigment concentration. After the body of ink in the area D is suctioned out, the three way valve U is turned to connect the ink passage section 6B to the side toward which ink is suctioned out, and the bodies of ink in the areas B and C are suctioned out to continue the recovery operation as shown in FIG. 16.

In this embodiment, unlike the cap 19, that is, the cap in the first or second embodiment, the cap 28 does not need to be provided with a projection (21). It is only the plate 29, or the plate which comes into contact with the valve mechanism, that the cap 28 needs to be provided. Therefore, this embodiment is simpler in terms of the shape of the recovery cap (28) than the second embodiment.

Embodiment 4

Figure 17:
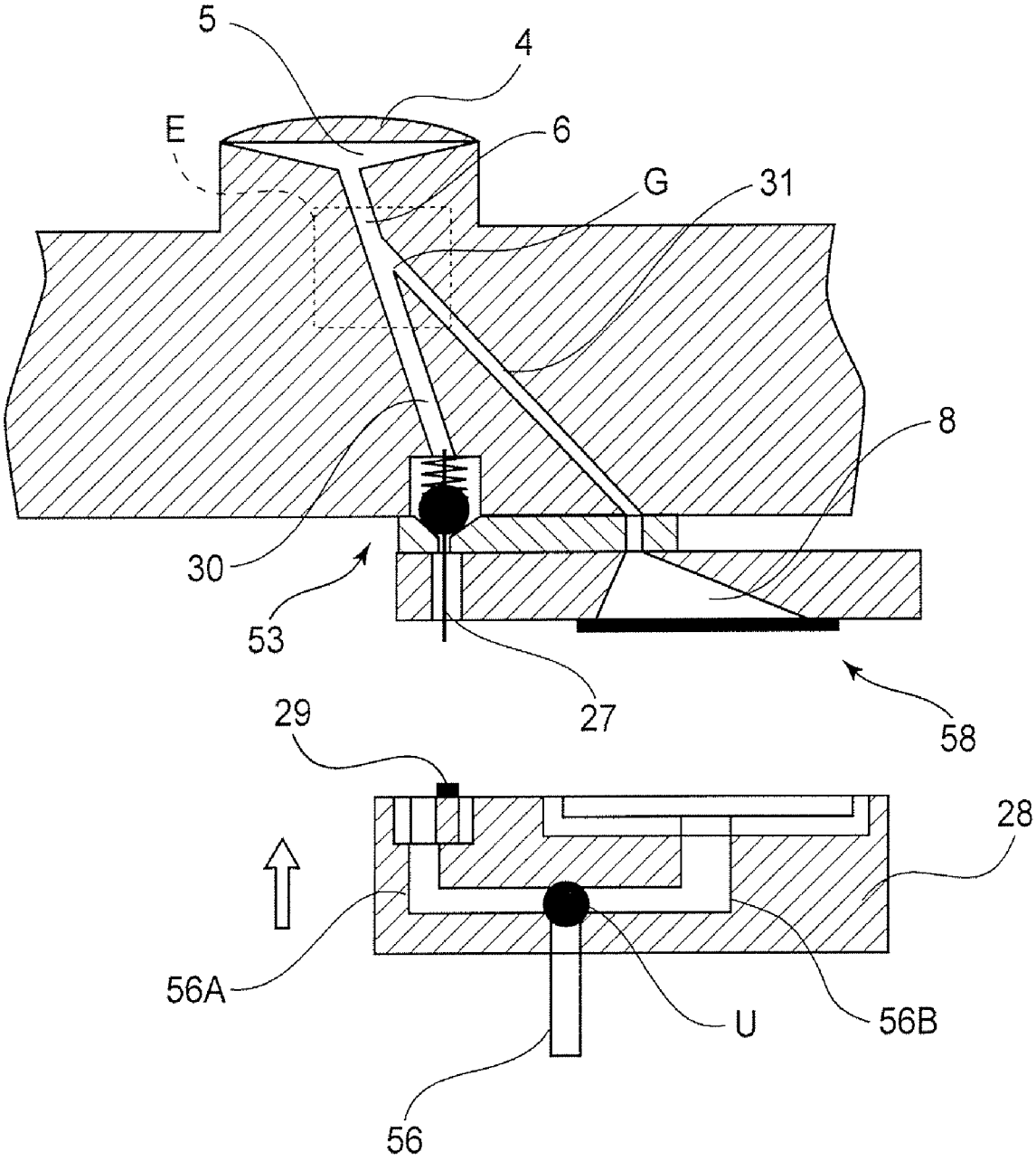
FIG. 17 is a sectional view of the ink jet recording cartridge, which is an integral combination of a recording head and an ink container (or ink containers), and the recovery cap, in the fourth embodiment.
Figure 18:
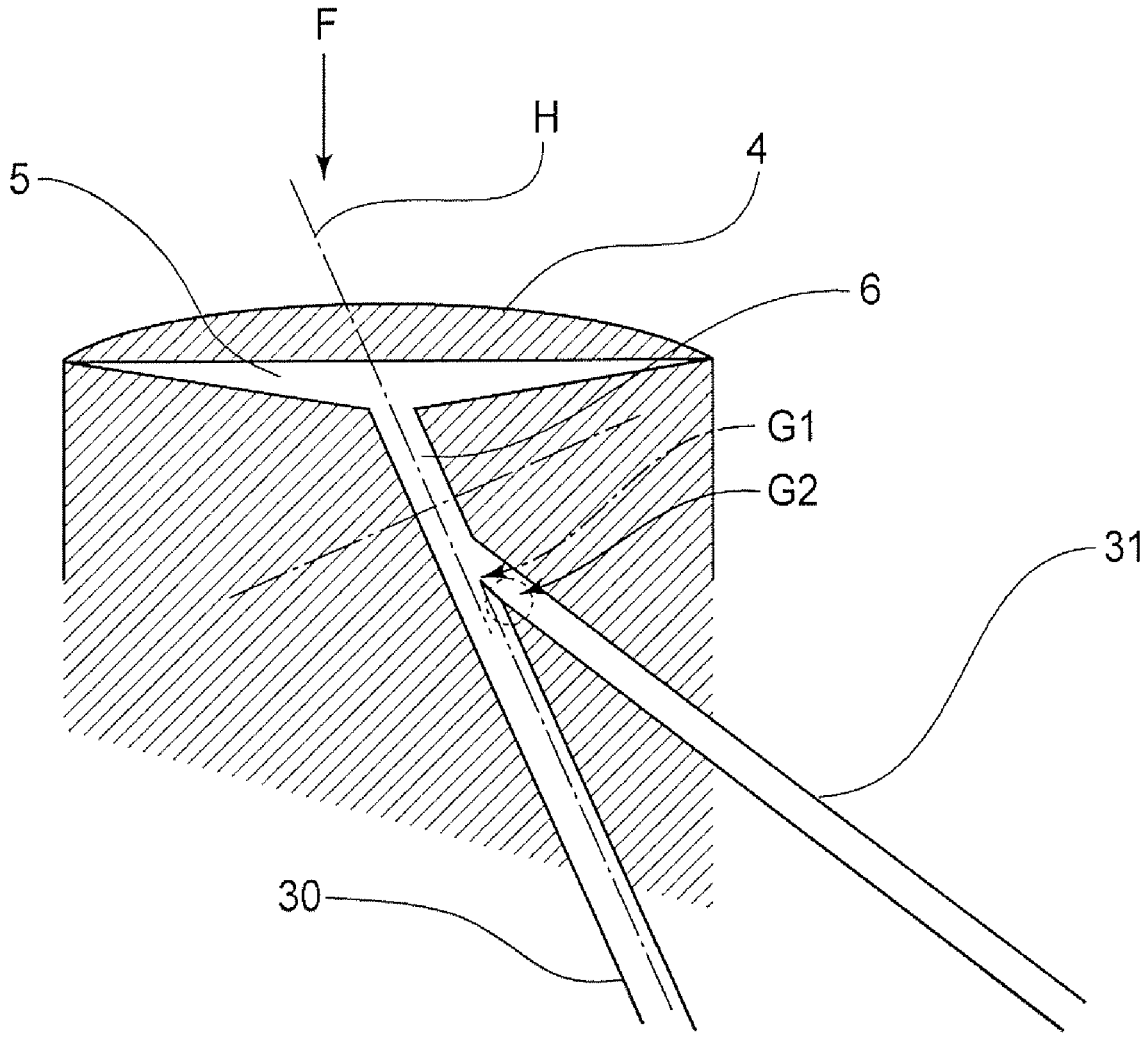
FIG. 18 is an enlarged sectional view of the point of the ink passage, at which the ink passage branches, and the adjacencies of this branching point.
Figure 19:
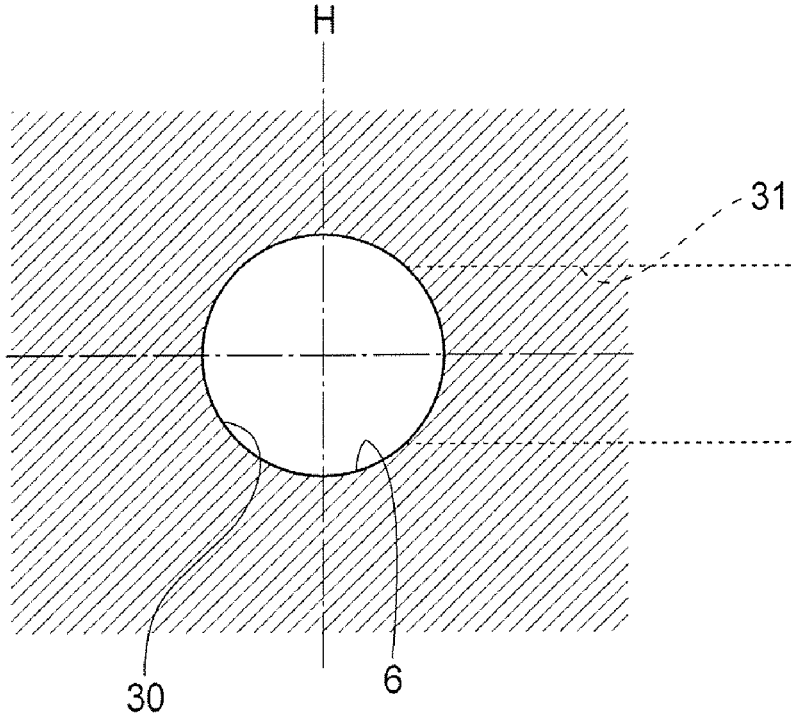
FIG. 19 is a view of the ink passage shown in FIG. 18, as seen from the direction indicated by an arrow mark F in FIG. 18.

Next, referring to FIGS. 17-19, the fourth embodiment of the present invention will be described. This embodiment is different from the third embodiment in that the ink passage sections 6, 30, and 31 of the cartridge 1 in this embodiment, which correspond to the ink passage sections 6, 6A, and 6B of the cartridge 1 in the third embodiment, are inclined. The section 6 branches into the sections 30 and 31 at a branching point G (sections 6 and 30 will be together referred to as section 30, for convenience) in the area E. The section 31 leads into the liquid chamber 8. The section 30 is the ink passage section in into which the pigment easily sediments, and which is provided with a valve mechanism, which is located at the bottom end of the section 30. FIG. 18 is an enlarged view of the area E shown in FIG. 17, which is the adjacency of the branching point G.

Both the ink passage sections 30 and 31 are inclined relative to the vertical direction. The ink passage section 31, which branches from the section 30, is greater in inclination angle, relative to the vertical direction, than the section 30. FIG. 19 is a view of the internal wall of the ink passage, as seen from the direction indicated by an arrow mark F in FIG. 18. It is evident from FIG. 19 that the ink passage section 30 is tubular and the section 31 branches out from the portion of the internal wall of the ink passage section 30 at the branching point G, in such a manner that the border line between the ink passage sections 30 and 31 curves as if the ink passages 30 were intact. Thus, the section 31 is not visible in the area of the drawing, which corresponds to the internal space of the section 30. Based on the knowledge of the inventors of the present invention, in order to enhance the sedimentation of the pigment into the ink passage 30, it is desired that a branching point G2 shown in FIG. 18 is not on the valve mechanism side of the center line H of the ink passage section 6 (left side of center line H in FIGS. 17-19). That is, it is desired that the recording head 57 is structured so that the border line between the ink passage portions 30 and 31 does not intersect with the center line of the ink passage section 30, nor is on the valve mechanism side of the center line. Pigment sediments in the direction of gravity. Therefore, structuring the cartridge 1 as described above make is possible to guide the pigment into the section 30 as the pigment sediments, while making it harder for the pigment to enter the section 31. In this embodiment, it is desired that the cartridge 1 is structured so that the border line between the ink passage sections 30 and 31 is on the recording head side of the center line H (right-hand side of center line H in FIGS. 17-19).

The double-dot chain line in FIG. 18 is for describing the case in which the cartridge 1 is structured so that a part of the section 31 is visible in the internal area of the ink passage section 30, as the ink passage section 30 is seen from the direction indicated by the arrow mark F, and also, so that the branching point G is on the recording head side (right-hand side) of the center line H of the section 30 of the ink passage. Also in this case, the cartridge 1 is structured so that the border line between the ink passage sections 30 and 31 is on the recording head side (right-hand side) of the center line H of the section 31 and does not intersect with the center line H. Pigment sediments in the direction of gravity. Therefore, structuring the cartridge 1 as described above makes it possible to guide the pigment into the section 30 of the ink passage as it sediments, making it therefore harder for the pigment enters the section 31 of the ink passage as it sediments.

Embodiment 5

Next, referring to FIGS. 20 and 21, the fifth embodiment of the present invention will be described.

In this embodiment, the ink passage 6 of the cartridge 1 bifurcates into sections 32 and 33. More specifically, the sections 33 branches out from the section 32 of the ink passage at a bifurcation point J, and leads into the liquid chamber 8. The ink passage section 32 is the section, into which the pigment can more easily sediment than the section 33. The section 32 is provided with a valve mechanism, which is located at the bottom end of the section 32.

Figure 21:
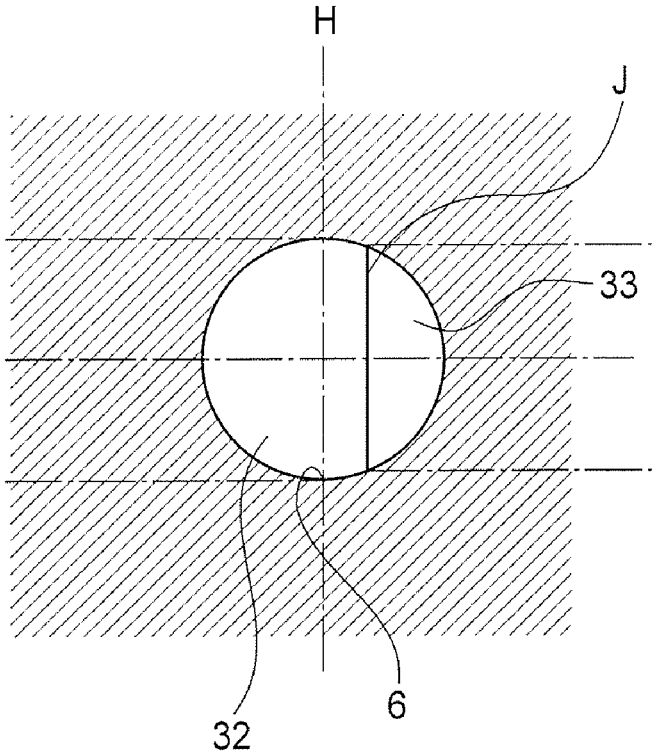
FIG. 21 is a view of the ink passage shown in FIG. 20, as seen from the direction indicated by an arrow mark I in FIG. 20.
Figure 20:
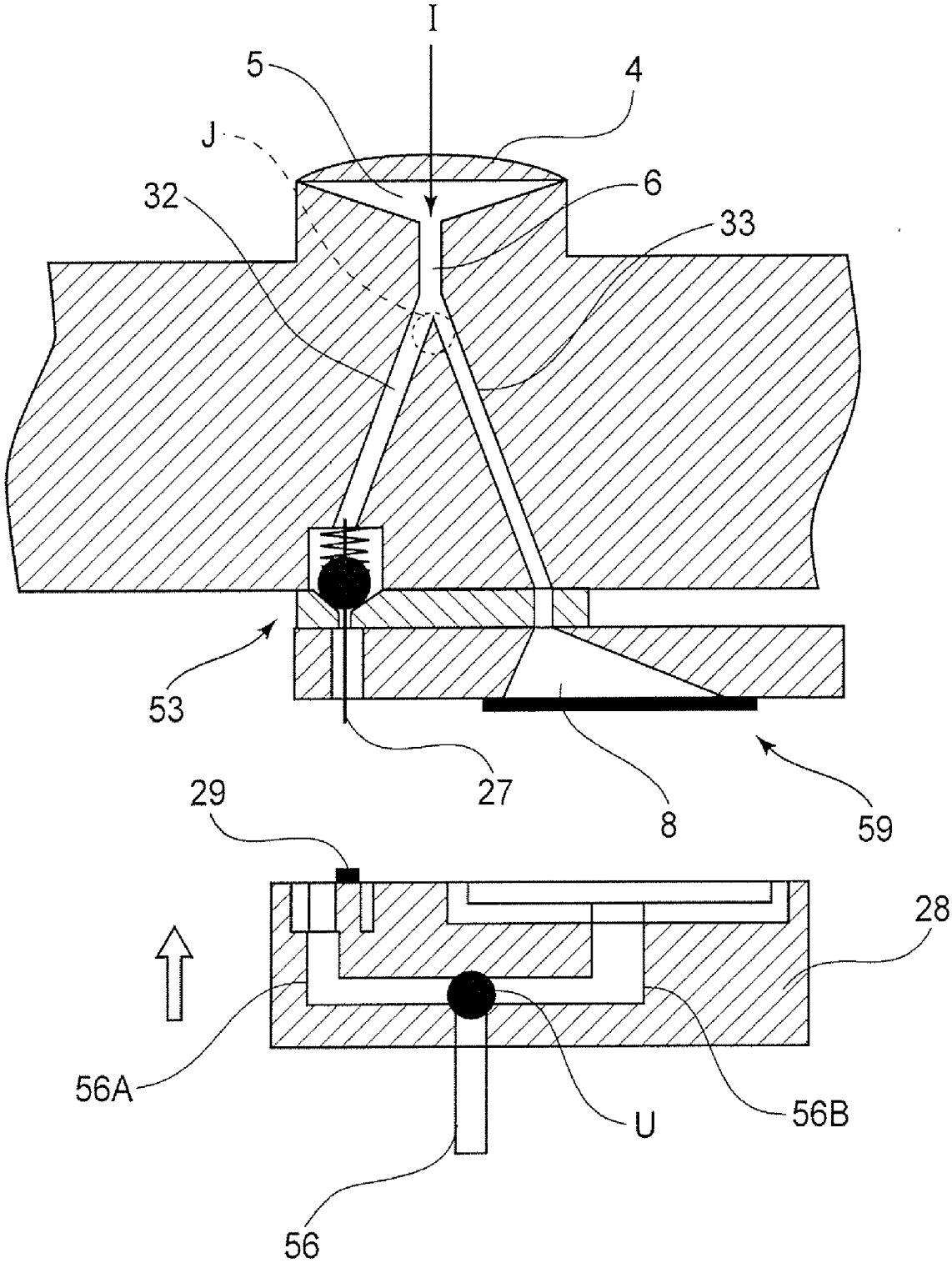
FIG. 20 is a sectional view of the ink jet recording cartridge, which is an integral combination of a recording head and an ink container (or ink containers), and the recovery cap, in the fifth embodiment.

FIG. 21 is a drawing of the sections 32 and 33 of the ink passage, which are seen from the direction indicated by an arrow mark I in FIG. 20. The section 32 of the ink passage is tubular. The section 33 of the ink passage branches from the section 32 of the ink passage, at the branching point J, which is on the recording head side of the center line H of the section 32. Based on the knowledge of the inventors of the present invention, in order to promote the sedimentation of pigment into the section 32, it is desired that the branching point J is on the recording head 59 side of the center line H of the section 32. That is, it is desired that the cartridge 1 is structured so that the border line between the ink passage sections 32 and 33 does not cross the center line H. From the standpoint of ensuring that the pigment sediments into the section 32 of the ink passage, setting the position of the branching point J as described above is effective, and is more effective than adjusting the angle at which the ink passage section 6 bifurcates into the sections 32 and 33. Pigment sediments in the direction of gravity. Therefore, structuring the cartridge 1 as described above makes it possible to guide the pigment into the section 32 of the ink passage while the pigment is sedimenting, making it harder for the pigment to enter the section 33 of the ink passage.

Miscellaneous Embodiments

Incidentally, in each of the above described preferred embodiments of the present invention, the present invention was applied to the ink jet recording cartridge, which is an integral combination of an ink cartridge (or ink cartridges) and an ink jet recording head. However, these embodiments are not intended to limit the present invention in scope. That is, the present invention is also applicable to an ink jet recording cartridge structured so that its ink jet recording head and ink container are separable from each other.

Figure 22:
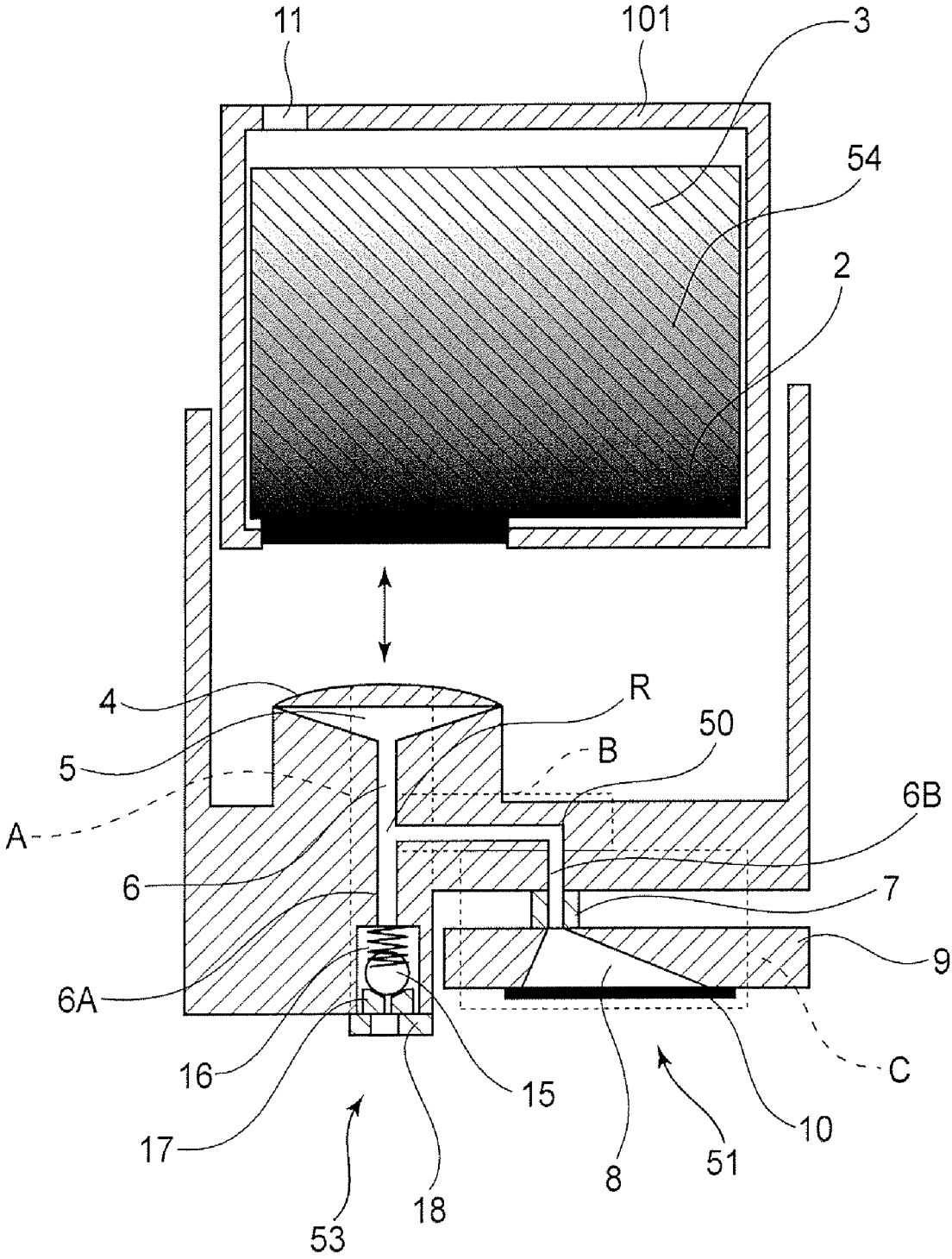
FIG. 22 is a schematic sectional view of an ink jet recording head, and an ink container separable from the ink jet recording head, showing their structures which make them separable.
Figure 23:
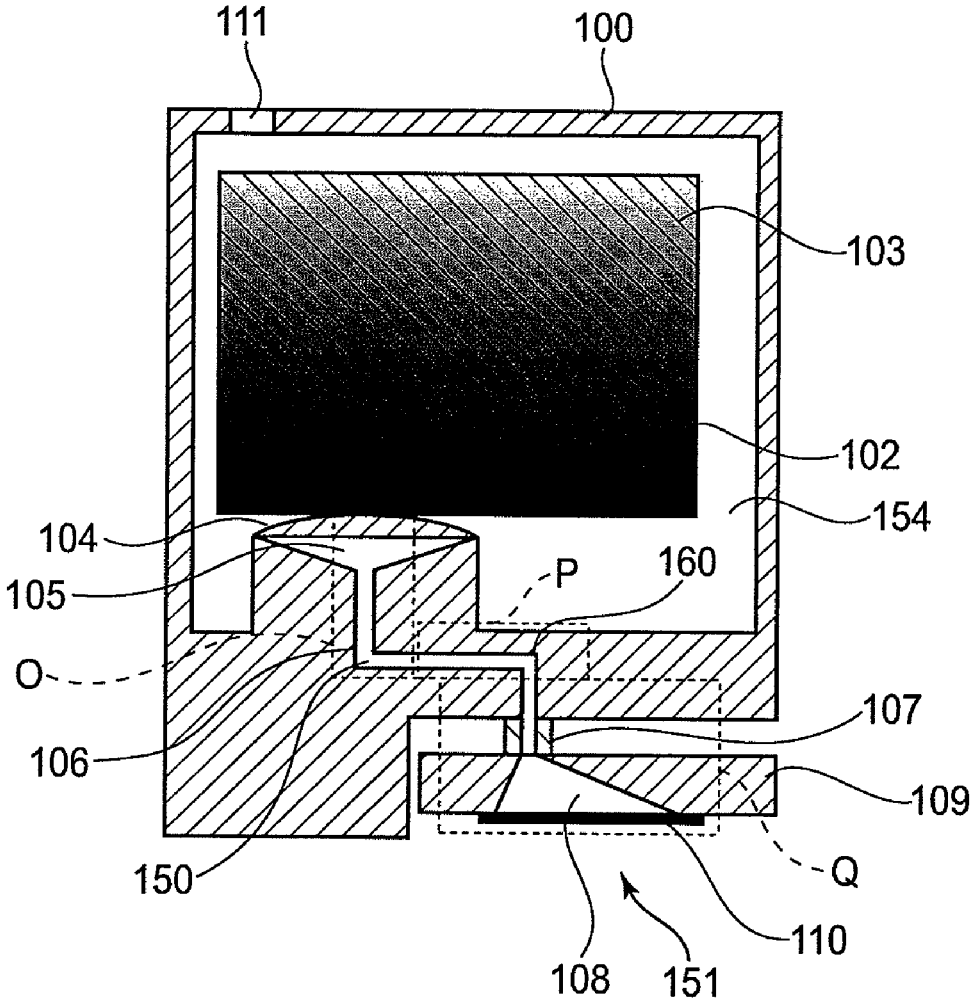
FIG. 23 is a sectional view of an ink jet recording cartridge, in accordance with the prior art, which is an integral combination of a recording head and an ink container (or ink containers).

FIG. 22 is a sectional view of a recording head in accordance with the present invention, which is independent from an ink container, and shows the structure of the recording head. The structure of this recording head is the same as the structure of the recording head portion of the ink jet recording cartridge 1 shown in FIG. 1, except that an ink container 101, that is, the ink container for this recording head, is removably attachable to the recording head. Therefore, the structure of this recording head will not be described in detail.

Also in each of the above described preferred embodiments of the present invention, it was pigment ink (ink which contains pigment) that was jetted from the recording head. However, the liquid to be jetted from the recording head does not need to be ink; it may be liquid other than ink. Also in each of the above described embodiments, it was the pigment in ink that was discharged through the section(s) of the ink passage, which branched from the primary section of the ink passage. However, the ingredient(s) in ink, which is to be discharged, may be ingredients other than the pigment. Further, in each of the above described preferred embodiments, the recording apparatus was an ink jet recording apparatus. However, the present invention is applicable to recording apparatuses other than an ink jet recording apparatus. Further, the recording apparatus was of the serial scan type. However, the present invention is applicable to a recording apparatus of the full-line type, just as well.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 148841/2006 filed May 29, 2006 which is hereby incorporated by reference.

What is claimed is:

1. An ink jet recording head for ejecting, through an ink ejection outlet, ink introduced through an ink supply port, comprising:

a first ink flow path in fluid communication with the ink supply port;

a second ink flow path which is branched from said first ink flow path at a branch portion and which is in fluid communication with said ink ejection outlet; and a third ink flow path for fluid communication between said branch portion and an outside, wherein an angle at which said third ink flow path branches is larger than an angle formed between said first ink flow path and said second ink flow path at the branch portion.

2. An ink jet recording head according to claim 1, wherein an opening of said second ink flow path at the branch portion is not across a center line of said first ink flow path.

3. An ink jet recording head according to claim 1, wherein said first ink flow path and said second ink flow path have a linear structure and extend in a vertical direction in a state of said recording head facing vertically downward.

4. An ink jet recording head according to claim 1, further comprising an integral ink container which is in fluid communication therewith.

5. An ink jet recording head according to claim 1, wherein said ink comprises a pigment component.

6. An ink jet recording head for ejecting, through an ink ejection outlet, ink introduced through an ink supply port, comprising:

a first ink flow path in fluid communication with the ink supply port;

a second ink flow path which is branched from said first ink flow path at a branch portion and which is in fluid communication with said ink ejection outlet; and a third ink flow path for fluid communication between said branch portion and an outside, wherein said third ink flow path is provided with a valve mechanism in its outer side.

7. An ink jet recording head according to claim 6, wherein an opening of said second ink flow path at the branch portion is not across a center line of said first ink flow path.

8. An ink jet recording head according to claim 6, wherein said first ink flow path and said second ink flow path have a linear structure and extend in a vertical direction in a state of said recording head facing vertically downward.

9. An ink jet recording head according to claim 6, further comprising an integral ink container which is in fluid communication therewith.

10. An ink jet recording head according to claim 6, wherein said ink comprises a pigment component.

11. An ink jet recording head for ejecting, through an ink ejection outlet, ink introduced through an ink supply port, comprising:

a first ink flow path in fluid communication with the ink supply port;

a second ink flow path which is branched from said first ink flow path at a branch portion and which is in fluid communication with said ink ejection outlet; and a third ink flow path for fluid communication between said branch portion and an outside, wherein an ink container is detachably mountable to said ink jet recording head so that the ink supply port is in fluid communication with said ink container.

12. An ink jet recording head according to claim 11, wherein an opening of said second ink flow path at the branch portion is not across a center line of said first ink flow path.

13. An ink jet recording head according to claim 11, wherein said first ink flow path and said second ink flow path have a linear structure and extend in a vertical direction in a state of said recording head facing vertically downward.

14. An ink jet recording head according to claim 11, wherein said ink comprises a pigment component.

15. An ink jet recording apparatus for effecting recording, comprising:

an ink jet recording head for ejecting, through an ink ejection outlet, ink introduced through an ink supply port;

a first ink flow path in fluid communication with the ink supply port;

a second ink flow path which is branched from said first ink flow path at a branch portion and which is in fluid communication with said ink ejection outlet;

a third ink flow path for fluid communication between said branch portion and an outside, wherein an angle at which said third ink flow path branches is larger than an angle formed between said first ink flow path and said second ink flow path at the branch portion; and a discharging mechanism for discharging at least the ink existing in said third ink flow path to the outside.

16. An ink jet recording head according to claim 15, wherein an opening of said second ink flow path at the branch portion is not across a center line of said first ink flow path.

17. An ink jet recording head according to claim 15, wherein said first ink flow path and said second ink flow path have a linear structure and extend in a vertical direction in a state of said recording head facing vertically downward.

18. An ink jet recording head according to claim 15, further comprising an integral ink container which is in fluid communication therewith.

19. An ink jet recording head according to claim 15, wherein said ink comprises a pigment component.

20. An ink jet recording apparatus for effecting recording, comprising:

an ink jet recording head for ejecting, through an ink ejection outlet, ink introduced through an ink supply port;

a first ink flow path in fluid communication with the ink supply port;

a second ink flow path which is branched from said first ink flow path at a branch portion and which is in fluid communication with said ink ejection outlet;

a third ink flow path for fluid communication between said branch portion and an outside, wherein said third ink flow path is provided with a valve mechanism in its outer side; and a discharging mechanism for discharging at least the ink existing in said third ink flow path to the outside.

21. An ink jet recording apparatus for effecting recording, comprising:

an ink jet recording head for ejecting, through an ink ejection outlet, ink introduced through an ink supply port;

a first ink flow path in fluid communication with the ink supply port;

a second ink flow path which is branched from said first ink flow path at a branch portion and which is in fluid communication with said ink ejection outlet;

a third ink flow path for fluid communication between said branch portion and an outside, wherein an ink container is detachably mountable to said ink jet recording head so that the ink supply port is in fluid communication with said ink container; and a discharging mechanism for discharging at least the ink existing in said third ink flow path to the outside.

* * * * *